US005379100A

United States Patent [19]

Kudo et al.

[11] Patent Number: 5,379,100

[45] Date of Patent: Jan. 3, 1995

[54] CLEANING DEVICE FOR USE IN IMAGE FORMING APPARATUS

[75] Inventors: Tomoo Kudo; Junichi Hamada; Toshiya Sato, all of Hachioji, Japan

[73] Assignee: Konica Corporation, Tokyo, Japan

[21] Appl. No.: 118,970

[22] Filed: Sep. 9, 1993

[30] Foreign Application Priority Data

| | | | |
|---|---|---|---|
| Sep. 14, 1992 | [JP] | Japan | 4-270965 |
| Sep. 14, 1992 | [JP] | Japan | 4-270966 |
| Sep. 14, 1992 | [JP] | Japan | 4-270968 |
| Oct. 30, 1992 | [JP] | Japan | 4-316158 |

[51] Int. Cl.[6] ..... G03G 21/00

[52] U.S. Cl. ..... 355/299; 355/296

[58] Field of Search ..... 15/93.1, 97.1; 355/203, 355/204, 208, 205, 296, 297, 299

[56] References Cited

U.S. PATENT DOCUMENTS

| | | | |
|---|---|---|---|
| 4,145,137 | 3/1979 | Sunaga et al. . | |
| 4,702,591 | 10/1987 | Tsuda et al. . | |
| 4,937,633 | 6/1990 | Ewing | 355/299 |
| 4,969,015 | 11/1990 | Sanpe | 355/297 |
| 5,208,639 | 4/1993 | Thayer et al. | 355/299 |
| 5,264,904 | 11/1993 | Audi et al. | 355/299 |
| 5,278,620 | 1/1994 | Godlove | 355/299 |

FOREIGN PATENT DOCUMENTS

| | | |
|---|---|---|
| 55-12241 | 7/1953 | Japan . |
| 51-32335 | 3/1976 | Japan . |
| 58-68776 | 4/1983 | Japan . |
| 60-68571 | 5/1985 | Japan . |
| 61-103180 | 5/1986 | Japan . |

*Primary Examiner*—A. T. Grimley
*Assistant Examiner*—Sandra L. Brase
*Attorney, Agent, or Firm*—Frishauf, Holtz, Goodman & Woodward

[57] ABSTRACT

A cleaning device has a plurality of cleaning blades capable of coming into contact with an image carrier; a rotatable supporting shaft on which the blades are affixed; and a blade replacement mechanism that rotates the supporting shaft and thereby replaces the blade that is in contact with the image carrier with another blade by rotating the supporting shaft. The blade replacement mechanism includes a supporting shaft mover for moving a blade between a position in which the blade comes into pressure contact with the image carrier and a position in which the blade separated from the image carrier; a moving controller connected with the supporting shaft mover; and a rotator for rotating the blade supporting shaft when the blade takes a position in which the blade separates from the image carrier.

37 Claims, 28 Drawing Sheets

CLEANING DEVICE FOR USE IN IMAGE FORMING APPARATUS

BACKGROUND OF THE INVENTION

The present invention relates to an image forming apparatus wherein a blade is used for removing residual toner adhering to an image carrier, and more particularly, to an image forming apparatus equipped with a means that applies toner on the replaced fresh blade and thereby reduces frictional resistance between the blade and an image carrier.

In an image forming apparatus such as an electrophotographic copying machine, toner images formed on the surface of a photoreceptor drum are not transferred onto a transfer sheet completely, resulting in untransferred residual toners. For the continuous copying operation, it is necessary that the residual toners are removed completely by a cleaning member for cleaning. As a cleaning member, a blade made from an elastic substance such as polyurethane is used commonly. In the case of this blade, an edge of the blade is brought into contact with a photoreceptor drum to scrape off the residual toners, in which, however, the blade is required to be replaced with a fresh one for preventing insufficient cleaning caused by abrasion of the edge of the blade.

In a conventional image forming apparatus, an operator used to set on a photoreceptor drum the cleaning unit having the replaced fresh blade on the occasion of maintenance after completion of, for example, 150,000 copies. In this case, however, when a fresh blade comes in direct contact with a cleaned photoreceptor drum, there has been a possibility that the blade is damaged by the frictional resistance which is too high. Therefore, an operator used to reduce frictional resistance between them by smearing the blade with setting powder or applying toners on the photoreceptor drum.

However, replacement of blades requiring the additional jobs mentioned above has been complicated because each of the photoreceptor drum, developing unit and cleaning unit has needed to be adjusted.

When a single blade is replaced each time it is worn away on an apparatus, the replacement cycle is too short. Therefore, it has been suggested that a plurality of blades are provided on a conventional image forming apparatus, as described, for example, in Japanese Patent Publication Open to Public Inspection Nos. 51-32335 (32335/1976),58-68776 (68776/1983) and 61-1031890 (103180/1986) (hereinafter referred to as Japanese Patent O.P.I. Publication), and Japanese Utility Model Publication Open to Public Inspection Nos. 55-12241 (12241/1980) and 60-68571 (68571/1985). In the suggestion mentioned above, a plurality of blades are supported on a blade-supporting shaft, and after a predetermined amount of operation, or after a predetermined length of time, the blade-supporting shaft is rotated so that a used blade may be replaced with a fresh one.

In the blade-replacement method mentioned above, however, there has been a possibility that a blade is damaged due to frictional resistance between a fresh blade and a photoreceptor drum as stated above, when a blade is replaced automatically.

Further, the invention relates to a cleaning device equipped with a plurality of blades.

However, when a blade-supporting shaft is rotated under the condition that a blade is in contact with a photoreceptor drum, there has been fear that the surface of the drum is damaged. Further, after cleaning, in order to prevent that the photoreceptor drum is damaged or a mark of paper dust stays on the photoreceptor drum, it has been required that the pressure force of the blade against toner and paper dust squeezed between the blade and the photoreceptor is released. Thus, an operation to move a blade away from the surface of a photoreceptor drum is needed, and when the blade-moving operation is conducted concurrently with the rotation of the blade-supporting shaft, there has been fear that blades tend to be replaced at frequency that is more than necessary.

Further, the invention relates to a cleaning device wherein a blade-supporting shaft on which a plurality of blades are affixed is rotated for blade replacement. The cleaning device mentioned above is structured so that the blade-supporting shaft that holds firmly plural blades is rotated for blade replacement each time it has operated for predetermined quantity of operation or predetermined length of time. In a cleaning device of this type, the blade-supporting shaft has been rotated either manually or through a driving means such as a rotary solenoid or a driving motor, and an angle of rotation of the blade-supporting shaft has needed to be controlled strictly because the blade has been required to be in pressure contact evenly with the photoreceptor drum at the predetermined angle and pressure.

However, it has been troublesome to rotate manually the blade-supporting shaft and to adjust an angle for the shaft each time, and it has been a disadvantage, on the other hand, that a driving motor used as a driving source makes an apparatus to be large in size and complicated.

For controlling a rotation angle strictly, there is considered an arrangement wherein locking members which engage with cutouts correspond in number to blades are provided on the blade-supporting shaft as described in Japanese Utility Model O.P.I. Publication No. 55-12241 (12241/1980). However, there has been fear that locking is impossible when a stopping position of rotating cutouts is not accurate.

In a conventional cleaning device, there has been fear that toner scatters out of a device when replacing blades because no instruction was made for the rotating direction of the blade-supporting shaft.

Further, the durability of a blade varies due to the cause such as that an amount of residual toner varies depending on conditions of usage of an electrophotographic copying machine. In the case of a type of plural blades, for example, the durability of a blade used after the use of its preceding blade is shorter than that of the preceding blade by a fall of environmental condition for usage caused by lapse of time, and durability also varies sometimes depending on each blade.

When the blade replacement time is fixed independently of usage conditions of an electrophotographic copying machine, there occur problems such as that cleaning is insufficient and that the blade is replaced even when it can further be used.

Further, the conditions of an image forming apparatus are required to be checked for replacing a blade after the blade replacement time has passed. It is necessary to pay attention so that a transfer sheet may not be soiled, an apparatus may not be affected adversely, and no downtime may be caused on operation of the apparatus, all by replacement of a blade.

In a conventional cleaning device, an edge of a blade does not come into contact evenly with the circumferential surface of a photoreceptor drum when it is mounted improperly and there has accordingly been fear of occurrence of improper cleaning, because of the blade fixed on the blade-supporting shaft. It has further been complicated to affix plural blades so that all of them may be in parallel to the circumferential surface of the photoreceptor.

The invention further relates to a cleaning device wherein a blade-supporting shaft on which a plurality of blades are affixed is rotated by elastic force of an elastic member for blade replacement.

Owing to a driving source of the elastic member by which the blade-supporting shaft is urged to rotate, it is possible to make the device small in size and simple in structure. However, when elastic energy of the elastic member is given off directly, there occurs fear that toner sticking to a blade scatters outside due to rapid rotation of the blade-supporting shaft on the occasion of blade replacement. Moreover, it is necessary to charge elastic energy after rotation power has been given off due to blade replacement, because the elastic force of the elastic member is limited.

SUMMARY OF THE INVENTION

The first object of the invention is to provide an image forming apparatus wherein blade replacement operation is simplified, a fresh blade is not dog-eared after replacement and thereby no insufficient cleaning caused by blade damage takes place.

The second object of the invention is to provide a cleaning device which does not cause any fear that an image carrier and a blade may be damaged even when a blade-supporting shaft is rotated for blade replacement. Further object is to provide a cleaning device wherein a supporting-shaft-moving means is provided and thereby a blade is separated away from an image carrier, cleaning-releasing and blade-replacement are clearly discriminated, and thereby a blade may not be replaced carelessly.

The third object of the invention is to provide a cleaning device wherein an elastic member that urges a blade-supporting shaft to rotate is provided and thereby it is expected that the device may be made small with a simple driving source. Further object is to provide a cleaning device wherein accurate positioning and locking may be made on the occasion of blade replacement, and toner is prevented from scattering outside when the blade-supporting shaft rotates.

The fourth object of the invention is to provide an image forming apparatus wherein a blade can be replaced in accordance with usage conditions, blade replacement does not cause soiling of a transfer sheet and does not affect the apparatus adversely, and a blade can be replaced without any downtime in operation.

The fifth object of the invention is to provide a cleaning device which makes a blade to be replaced easily and is equipped with a plurality of blades capable of coming into contact with an image carrier evenly and in parallel with the image carrier constantly.

The sixth object of the invention is to provide a cleaning device wherein a blade-supporting shaft does not rotate abruptly when replacing a blade even when a driving source for rotating the blade-supporting shaft is an elastic member, and thereby there is no fear that toner scatters outside.

The seventh object of the invention is to provide a cleaning device wherein a supporting-shaft-rotating means is equipped with an elastic-energy-charging means and thereby a blade can be replaced surely even the structure is simple.

The first embodiment of the invention is represented by an image forming apparatus comprising a driving means that rotates an image carrier, a developing unit that deposits toner on the image carrier, a replaceable blade that scrapes off toner staying on the circumferential surface of the image carrier after transferring, a blade moving means capable of moving the blade to a blade-contact position and to a blade-non-contact position both around the image carrier, and a control means that controls operations of those including the blade moving means, the driving means and the developing unit, wherein the control means is provided with a blade-replacement-operating circuit that operates the developing unit for depositing the toner on the entire circumferential surface of the image carrier while rotating the image carrier when replacing the used blade with a fresh blade at the blade-non-contact position, operates the blade moving means to move the fresh blade to the blade-contact position, causes the fresh blade to slide on the toner sticking to the image carrier and then moves the fresh blade to the blade-non-contact position.

The second embodiment of the invention is represented by the first embodiment wherein the aforementioned blade means a plurality of blades affixed on a blade-supporting shaft capable of rotating, and the blade moving means mentioned above is equipped with a blade replacement mechanism that replaces the blade with other blade by rotating the blade-supporting shaft for bringing a blade into contact with the image carrier.

In the first embodiment of the invention mentioned above, when replacing the used blade with a fresh blade at the blade-non-contact position in accordance with the blade-replacement-operating circuit of the control means, the developing unit is operated while the image carrier is being rotated by the driving means so that toner may be deposited on the entire circumferential surface of the image carrier. On the other hand, the blade moving means is operated and thereby, a fresh blade is moved to the blade-contact position to come into contact with toner on the image carrier. Under this condition, the image carrier is rotated. Frictional resistance between the image carrier and the fresh blade is reduced because of the fresh blade on which the toner is deposited. After that, the fresh blade is moved to the blade-non-contact position.

In the second embodiment of the invention mentioned above, a plurality of blades affixed on the blade-supporting shaft are rotated by means of the blade-replacement mechanism and a blade that is in contact with the image carrier is replaced with other blade. In this case, the developing unit deposits toner on the entire circumferential surface of the image carrier and the fresh blade replaced through rotation is caused to come into contact with the toner and to slide on the toner.

The third embodiment of the invention is represented by a cleaning device comprising a plurality of blades capable of coming into contact with an image carrier, a rotary blade-supporting shaft on which the plural blades are affixed, and a blade-replacement mechanism that rotates the blade-supporting shaft and thereby replaces the blade being in contact with the image carrier with other blade, wherein the blade-replacement mechanism mentioned above is equipped with a supporting-shaft-moving means capable of moving the blade to a blade-contact position and to a blade-non-contact position both around the image carrier, a movement control means to be connected to the supporting-shaft-moving means, and a supporting-shaft-rotating means that rotates the blade-supporting shaft when the blade is in the blade-non-contact position.

In the fourth embodiment of the invention, the blade-non-contact position of the supporting-shaft moving means has two positions including a non-cleaning position and a blade-replacement position, and the supporting-shaft rotating means has a rotation control means that rotates the blade-supporting shaft only when the supporting-shaft moving means arrives at the blade-replacement position.

The fifth embodiment of the invention is represented by the fourth embodiment mentioned above wherein the supporting-shaft moving means has a cam mechanism linked with the blade-supporting shaft, and the cam mechanism is provided with a movement-regulating member that is equipped with a cam surface covering the range from the blade-contact position to the blade-replacement position through the non-cleaning position and prevents the use of a cam surface connecting directly the blade-replacement position to the blade-contact position, and is further provided with a sensor that detects the above-mentioned positions.

The sixth embodiment of the invention is represented by the fourth embodiment mentioned above wherein the movement control means mentioned above has a timer built-in that moves the blade which has replaced the used one at the blade-replacement position back to the non-cleaning position after the passage of a certain period of time.

In the third embodiment of the invention mentioned above, the movement control means is used for driving the supporting-shaft moving means so that a blade may be set apart from the image carrier. Then, the supporting-shaft rotating means is operated to rotate the blade-supporting shaft on which blades are affixed so that the blade being in contact with the image carrier may be replaced with other blade. After that, the supporting-shaft moving means is driven again to move from the blade-non-contact position to the blade-contact position and thereby to bring other blade into contact with the image carrier.

In the fourth embodiment of the invention, the blade-non-contact position takes two steps of a non-cleaning position and a blade-replacement position, and a rotation control means releases the supporting-shaft rotating means for rotation only when the supporting-shaft moving means arrives at the blade-replacement position so that the blade-supporting shaft may rotate.

In the fifth embodiment of the invention, the supporting-shaft moving means moves a blade, by means of a cam mechanism linked with a blade-supporting shaft, from the blade-contact position to the non-cleaning position and further to the blade-replacement position. This movement is caused by rotation of the cam, and the rotation is regulated by a movement-regulating member so that the blade may not move directly from the blade-replacement position to the blade-contact position or from the blade-contact position to the blade-replacement position.

In the sixth embodiment of the invention, the blade which has replaced the used blade at the blade-replacement position is caused to stay at the position for a certain period of time, and then, it is brought back to the non-cleaning position when a movement control means drives the supporting-shaft moving means again.

The seventh embodiment of the invention is represented by a cleaning device comprising a plurality of blades capable of coming into contact with an image carrier, a rotary blade-supporting shaft on which the blades mentioned above are affixed and a supporting-shaft rotating means that rotates the blade-supporting shaft to replace the blade being in contact with the image carrier with other blade, wherein the supporting-shaft rotating means has an elastic member urges the blade-supporting shaft to rotate.

In the eighth embodiment of the invention, the supporting-shaft rotating means mentioned above is provided with a positioning member that causes the blade-supporting shaft urged by the elastic member to stop rotating at angular positions corresponding to the plural blades, and with a locking member that locks the positioned blade-supporting shaft.

The ninth embodiment of the invention is represented by a cleaning device comprising a plurality of blades capable of coming into contact with an image carrier, a rotary blade-supporting shaft on which the blades are affixed, a supporting-shaft rotating means that rotates the blade-supporting shaft so that the blade being in contact with the image carrier may be replaced with other blade, a supporting-shaft moving means capable of moving the blade so that the blade may either come into contact with or leave the image carrier, and a housing in which the blade-supporting shaft is provided, wherein the supporting-shaft moving means is provided with a swinging means that swings the blade-supporting shaft forward and backward along a circular path passing through the blade-contact position, the non-cleaning position and the blade-replacement position, while the supporting-shaft rotating means is provided with an elastic member that urges the swinging means to swing in the direction opposite to the swinging direction from the blade-replacement position to the non-cleaning position.

In the tenth embodiment, there is provided a seal member through which the housing mentioned above comes into friction contact with a blade holder at the non-cleaning position.

In the seventh embodiment of the invention, a supporting-shaft rotating means is operated and a blade-supporting shaft on which blades are affixed is rotated so that the blade being in contact with the image carrier may be replaced with other blade. The driving source for rotation power is based on elastic force of an elastic member provided on the blade-supporting shaft.

In the eighth embodiment of the invention, the blade-supporting shaft rotated by elastic force of the elastic member is stopped by the positioning member at an angle corresponding to the relevant blade. The blade-supporting shaft positioned at the angular position mentioned above is locked by a locking member so that the blade may be brought into contact with the image carrier at the predetermined angle.

In the ninth embodiment of the invention, a blade-supporting shaft is moved from the blade-contact position to the blade-replacement position through the non-cleaning position by the swinging means of the supporting-shaft moving means. This movement is on a circular path, and the blade-supporting shaft rotates at the blade-replacement position. The direction of its swinging is opposite to that of swinging from the blade-replacement position to the non-cleaning position. Therefore, toner sticking to the blade is scattered in the direction of leaving the image carrier, namely, toward inside of the housing of the cleaning device.

In the tenth embodiment of the invention, when a blade holder is swung from the blade-replacement position to the non-cleaning position, a seal member comes into frictional contact with a blade holder. A reaction of the phenomenon causes torque by means of frictional force on the swinging blade holder. This torque is used for compensating a torque necessary for blade replacement when it is insufficient.

In the eleventh embodiment of the invention, an image forming apparatus comprising an image carrier carrying images to be transferred onto a transfer sheet, a plurality of blades capable of coming into contact with the image carrier, and a blade-replacement mechanism that replaces the blade being in contact with the image carrier with other blade is provided with a replacement timing inputting means in which the replacement timing for the blade can be inputted, a rewritable memory means that stores replacement timing inputted from the replacement timing inputting means and a control means that makes it possible to replace a blade at the replacement timing stored in the memory means.

The twelfth embodiment of the invention is represented by the eleventh embodiment mentioned above wherein there are provided a sheet ejection detecting means that detects that a transfer sheet onto which the toner image has been transferred is ejected out from the main body of an apparatus, a replacement timing inputting means in which the replacement timing for the blade can be inputted, a rewritable memory means that stores the replacement timing inputted from the replacement timing inputting means, and a control means that makes it possible to replace a blade at the replacement timing stored in the memory means after the detection by means of the sheet ejection detecting means.

The thirteenth embodiment of the invention is represented by the eleventh embodiment which is provided with a power turn-on detecting means that detects power turn-on on the main body of the apparatus, a replacement timing inputting means capable of inputting the replacement timing for the blade, a rewritable memory means that stores the replacement timing inputted from the replacement timing inputting means, and a control means that makes it possible to replace a blade at the replacement timing stored in the memory means after the detection by means of the power turn-on detecting means.

The fourteenth embodiment of the invention is represented by the eleventh embodiment which is provided with a fixing unit that heats the transfer sheet onto which a toner image carried by the image carrier has been transferred and applies pressure thereon for fixing, and a means that judges whether the fixing temperature of the fixing unit at the timing of power turn-on for the main body of the apparatus makes it possible to replace the blade or not.

In the eleventh embodiment of the invention mentioned above, the replacement timing for a blade is inputted by means of a replacement timing inputting means, the replacement timing from the replacement timing inputting means is stored in a rewritable memory means, the replacement timing for a blade is set freely, and a blade can be replaced at the replacement timing set by the control means.

In the twelfth embodiment of the invention, the sheet ejection detecting means detects that the transfer sheet having thereon images transferred has been ejected out of the main body of an apparatus, and after that, a blade can be replaced at the replacement timing set by the control means.

In the thirteenth embodiment of the invention, the replacement timing inputting means detects that the power source for the main body of an apparatus has been turned on, and after that, a blade can be replaced at the replacement timing set by the control means.

In the fourteenth embodiment of the invention, it is judged whether the fixing temperature of a fixing unit makes a blade to be replaced or not on the occasion of power turn-on for the main body of an apparatus, and a blade is replaced when the fixing temperature allows the replacement.

The fifteenth embodiment of the invention is represented by a cleaning device comprising a plurality of blades capable of coming into contact with an image carrier, a rotary blade-supporting shaft that supports the blades, and a supporting-shaft rotating means that rotates the blade-supporting shaft so that the blade being in contact with the image carrier can be replaced with other blade, wherein the blade-supporting shaft is provided with a supporting member which supports the blade in a manner that the blade can swing along the circumferential surface of the image carrier.

In the sixteenth embodiment of the invention, there are provided a blade holder in which the blade is interposed and affixed, a bearing member provided at the central portion of the blade holder, and a shaft member that holds the blade holder through the bearing member and is affixed, at its one end, to the blade-supporting shaft.

In the fifteenth embodiment of the invention, the supporting-shaft rotating means is operated to rotate the blade-supporting shaft that supports blades, and thereby the blade being in contact with the image carrier is replaced with other blade. Since the blades are supported on the blade-supporting shaft through the supporting member so that the blades may swing, the blade after the replacement may also come into even contact with the circumferential surface of the image carrier.

In the sixteenth embodiment of the invention, a blade holder in which blades are interposed and affixed is provided, at its central portion, with a bearing member through which a shaft member passes. Though the shaft member is affixed on a blade-supporting shaft, blades and the blade holder may swing around the shaft member. Therefore, even after the blade replacement, the blade can come into even contact with an image carrier.

The seventeenth embodiment of the invention is represented by a cleaning device comprising a plurality of blades capable of making contact with an image carrier rotary blade-supporting shaft on which the blades are affixed, and a supporting-shaft rotating means which gives torque to the blade-supporting shaft by means of an elastic member so that the blade being in contact with the image carrier may be replaced with other blade, wherein the supporting-shaft rotating member is provided with a brake means that brakes the blade-supporting shaft.

In the eighteenth embodiment of the invention, the brake means is equipped with a friction member that makes contact with the blade-supporting shaft.

In the nineteenth embodiment of the invention, the friction member mentioned above is provided with a pressure spring whose contact surface is pressed against the blade-supporting shaft.

In the twentieth embodiment of the invention, the brake means is provided with an oil damper that is linked with the blade-supporting shaft.

In the twenty-first embodiment of the invention is represented by a cleaning device comprising a plurality of blades capable of making contact with an image carrier, a rotary blade-supporting shaft on which the blades are affixed, and a supporting-shaft rotating means which gives torque to the blade-supporting shaft by means of an elastic member so that the blade being in contact with the image carrier may be replaced with other blade, wherein the supporting-shaft rotating means is provided, as a means for charging elastic energy of the elastic member, with a drawing member that is wound round the blade-supporting shaft, and is provided, as a brake member to brake the blade-supporting shaft, with a spring member connected to the drawing member.

In the seventeenth embodiment of the invention, a supporting-shaft rotating means is operated to rotate a blade-supporting shaft on which blades are affixed so that the blade being in contact with an image carrier may be replaced with other blade. The driving source for the torque for the aforesaid rotation is based on elastic force of an elastic member accumulated in the blade-supporting shaft, and a rotation of the blade-supporting shaft is controlled by the brake means. As concrete members for that, there may be given a friction member that makes contact with the blade-supporting shaft and gives frictional resistance thereto and a pressure spring that presses the friction member on its back.

As in the twentieth embodiment of the invention, it is also possible to utilize attenuating force of an oil damper connected to a blade-supporting shaft.

In the twenty-first embodiment of the invention, elastic energy of an elastic member is charged by drawing out a drawing member wound round a blade-supporting shaft. In the case of blade replacement, the drawing member is also rewound when the blade-supporting shaft is rotated. However, elastic resistance force of a spring member connected to the drawing member attenuates the rewinding speed, and thereby a rotation of the blade-supporting shaft is also attenuated.

The twenty-second embodiment of the invention is represented by a cleaning device comprising a plurality of blades capable of making contact with an image carrier, a rotary blade-supporting shaft on which the blades are affixed, and a supporting-shaft rotating means which gives torque to the blade-supporting shaft by means of an elastic member so that the blade being in contact with the image carrier may be replaced with other blade, wherein the supporting-shaft rotating means is provided with a means for charging elastic energy of the elastic member.

The twenty-third embodiment of the invention is characterized in that the means for charging elastic energy is provided with a drawing member wound round the blade-supporting shaft, while, in the twenty-fourth embodiment of the invention, the means for charging elastic energy is provided with a swinging knob for swinging the blade-supporting shaft.

In the embodiment of the invention mentioned above is represented by the twenty-fourth embodiment of the invention wherein the swinging knob is provided with a torque-transmission means connected to the blade-supporting shaft.

In the embodiment of the invention mentioned above, a supporting-shaft rotating means is operated to rotate a blade-supporting shaft on which blades are affixed so that the blade being in contact with an image carrier may be replaced with other blade. The driving source for the torque for the aforesaid rotation is based on elastic force of an elastic member accumulated in the blade-supporting shaft. This elastic force is caused by the means for charging elastic energy accumulated in the supporting-shaft rotating means, and concrete members for that include a drawing member wound round the blade-supporting shaft, a swinging knob with which the blade-supporting shaft is swung, and further a swinging knob with which the blade-supporting shaft is swung through a swinging-force-transmission means. In either case among the foregoing, the elastic member which has lost its torque due to blade replacement is charged with elastic energy manually.

DETAILED DESCRIPTION OF THE PREFERRED EMBODIMENTS

Figure 1:
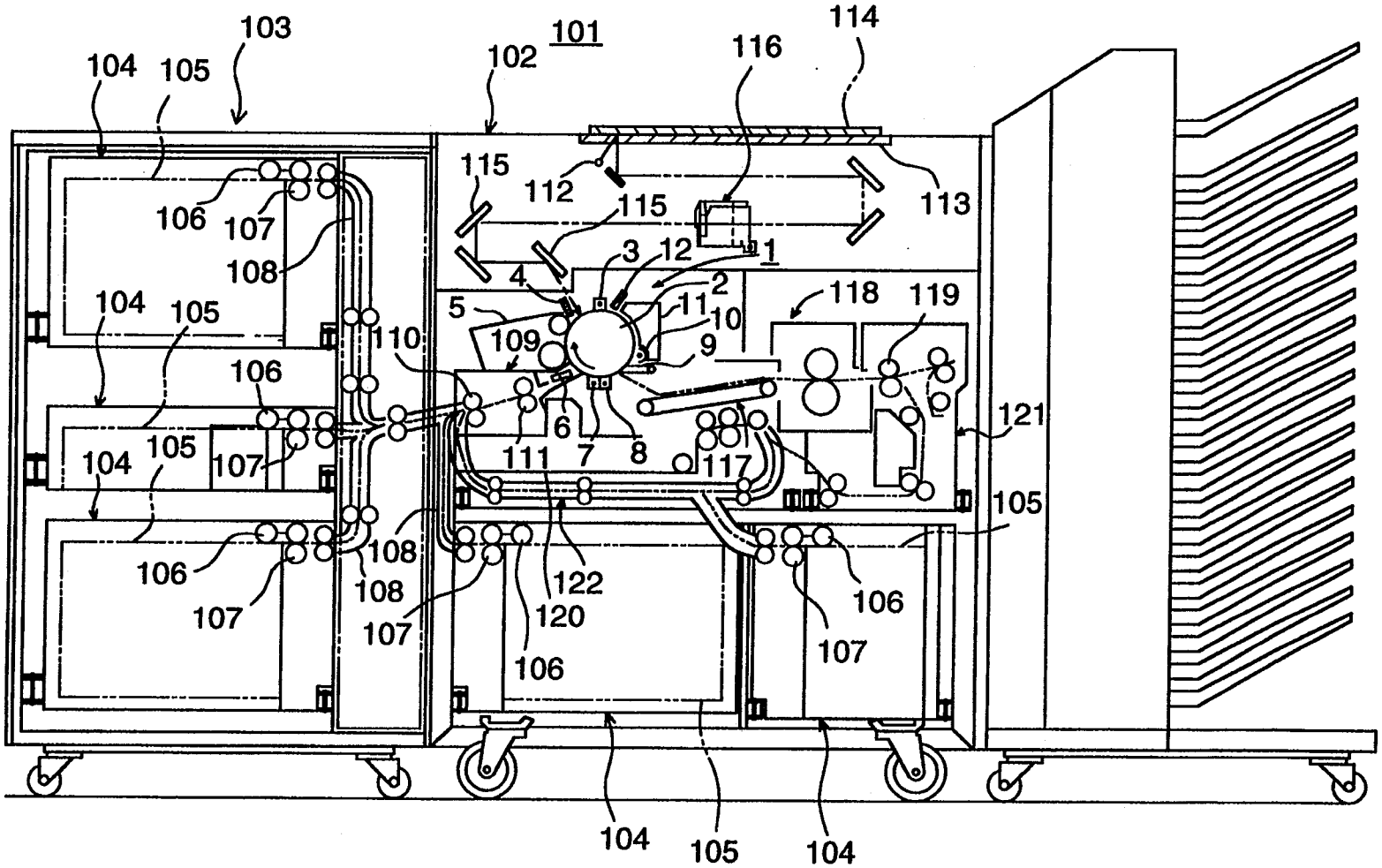
FIG. 1 is a schematic structural diagram of an image forming apparatus.
Figure 2:
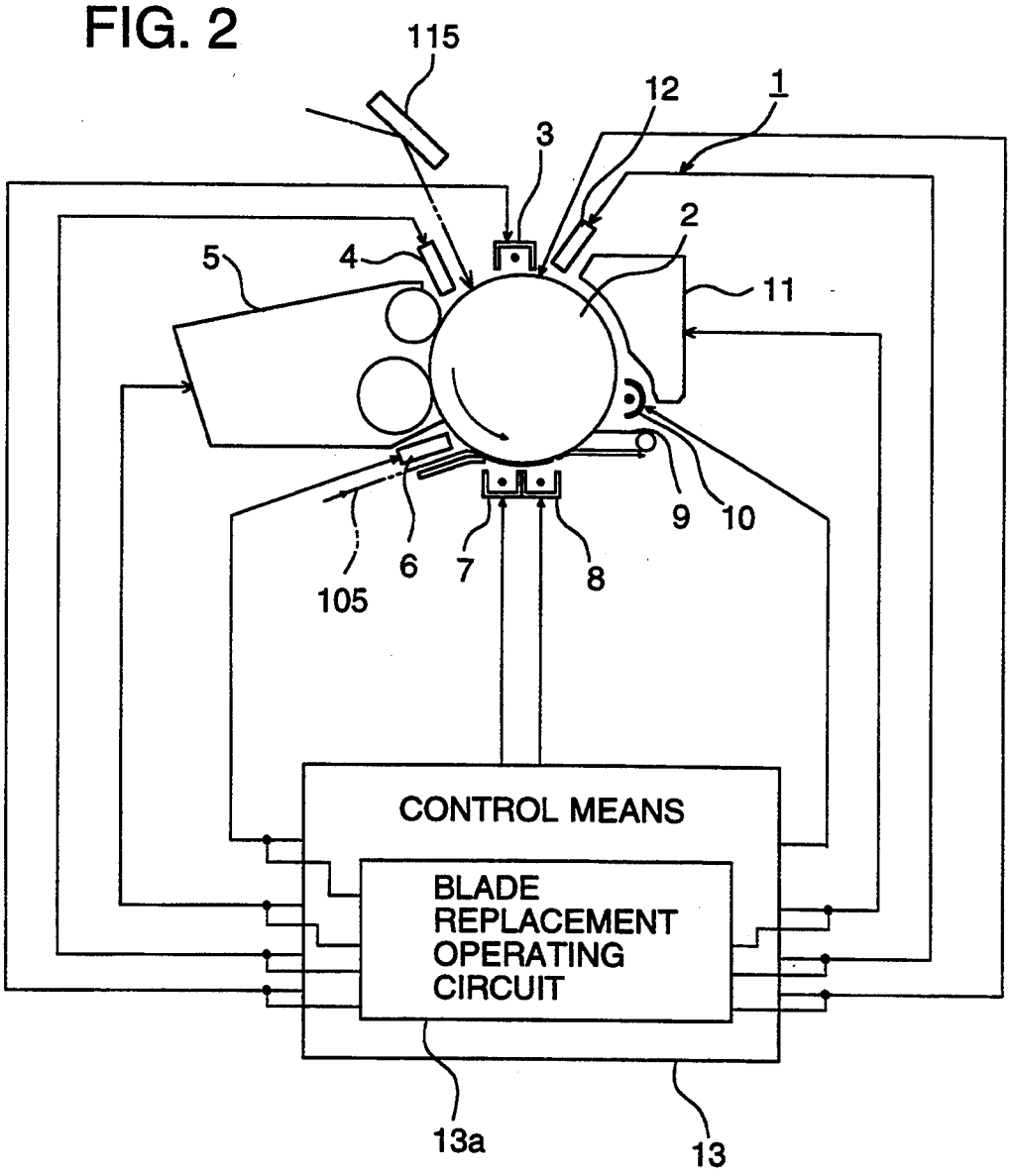
FIG. 2 is a schematic structural diagram of a transfer processing section.
Figure 3:
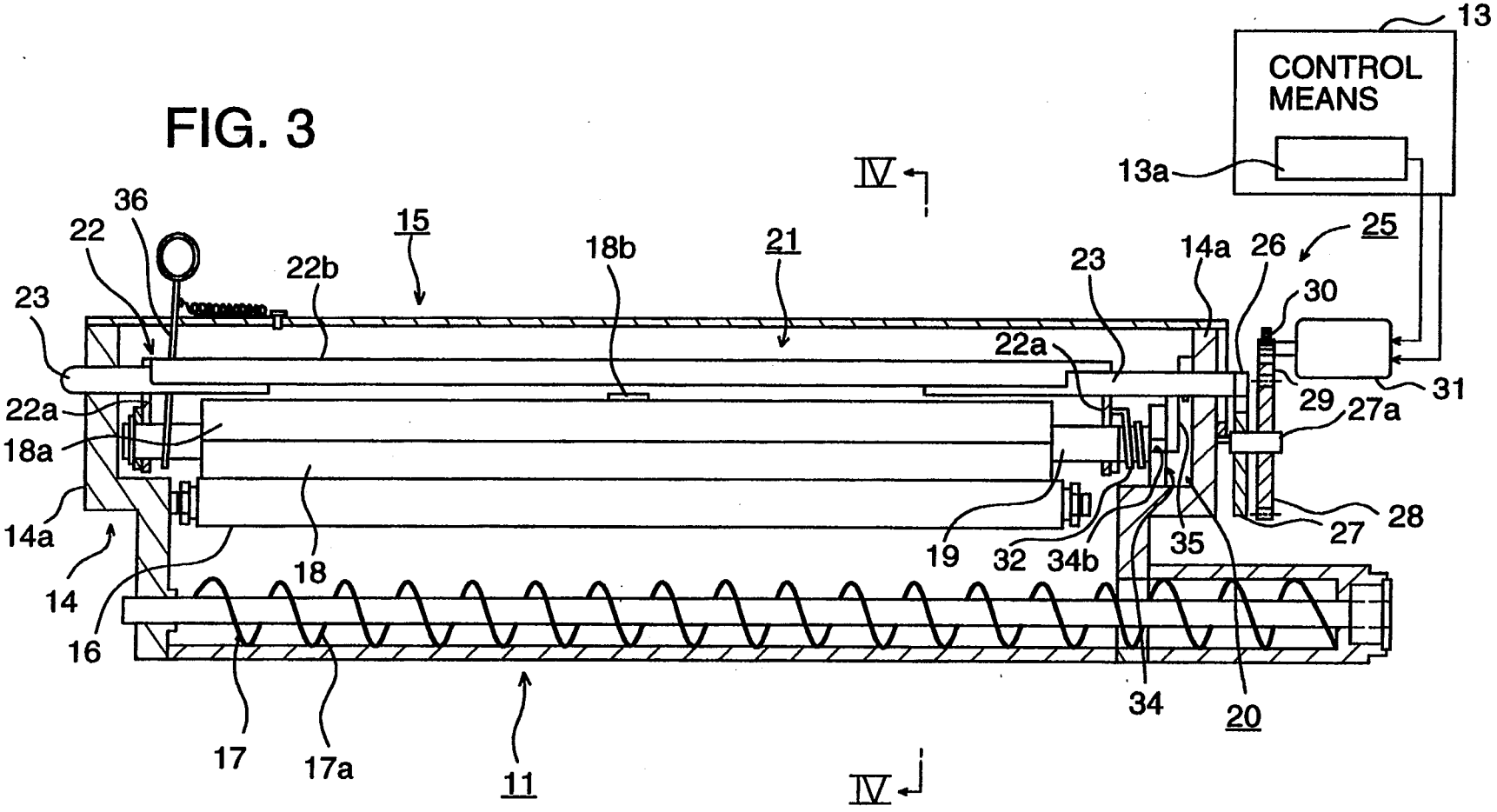
FIG. 3 is a front sectional view of a cleaning unit.
Figure 4:
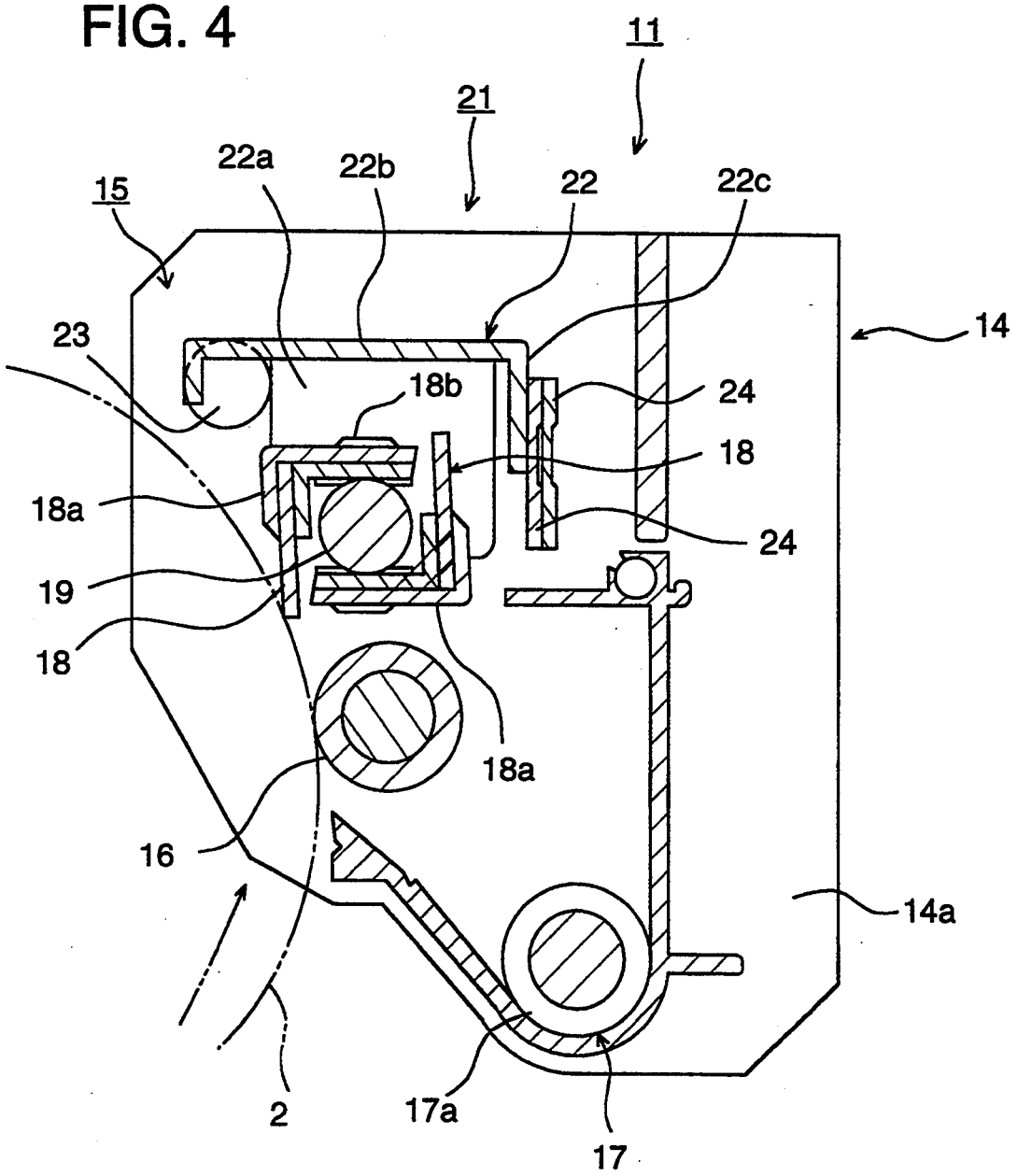
FIG. 4 is a sectional view taken on line IV—IV in FIG. 3.

An example of a cleaning device of the invention will be explained as follows, referring to the drawings attached herewith. FIG. I is a schematic structural diagram of a copying machine that is an image forming apparatus, FIG. 2 is a schematic structural diagram of a transfer processing section of the copying machine, FIG. 3 is a front sectional view of a cleaning unit, and FIG. 4 is a sectional view taken on line IV—IV in FIG. 3.

Copying machine 101 is composed of main body portion 102 and sheet feeding unit 103 connected to the main body section each being provided with a sheet feeding deck. Inside the sheet feeding unit 103 and the main body section 102, there are provided a plurality of sheet feeding decks 104 each holding transfer sheet 105. On the top surface of the transfer sheet 105 in each sheet feeding deck, there is provided sheet feeding roller 106 which feeds out transfer sheets intermittently. Each sheet feeding roller 106 is provided with double-feed-prevention means 107 for feeding out the transfer sheets 105 to the following step one sheet by one sheet. Transfer sheet 105 fed out from each sheet feeding deck 104 is guided by guide plate 108 and is transported to second sheet feeding section 109 incorporated in the main body section 102. The second sheet feeding section 109 is to be located immediately before transfer processing section 1 and is provided with buckling roller 110 and registration roller 111.

On photoreceptor 2 that constitutes the transfer processing section 1, on the other hand, there is given uniform charging by means of charging electrode 3, and light emitted from light source 112 and reflected on document 114 on platen glass 113 is projected on the circumferential surface of the photoreceptor 2 which serves as an image carrier through mirror 115 and lens system 116, thus, electrostatic latent images are formed on the photoreceptor. The electrostatic latent images are developed by developing unit 5 to form toner images. In synchronization with a rotation of the photoreceptor 2, registration roller 111 is driven so that transfer sheet 105 may be fed into transfer electrode 7 and separation electrode 8 for transfer of toner images. After that, the transfer sheet 105 is separated from the photoreceptor 2 by separation claw 9 and is put on conveyance unit 117 to be conveyed to fixing unit 118 which is a following step. Around the photoreceptor 2, on the other hand, there is provided cleaning unit 11 at the downstream side of the separation claw 9 to clean the surface of the photoreceptor 2 after transferring and then the surface is charged by charging electrode 3 again for the succeeding image forming.

The transfer sheet 105 heated and pressurized in fixing unit 118 has toner images thereon fixed, and is interposed by conveyance rollers 119 to be delivered to an unillustrated sheet-ejection tray in the case of one-side copying. In the case of two-side copying, the transfer sheet 105 is fed from the conveyance roller 119 into shunting path 121 leading to stacker 120 where the copied transfer sheet 105 is shunted temporarily. The transfer sheet 105 shunted in the stacker for a while is fed out again to be conveyed to second sheet feeding section 109 through horizontal conveyance path 122.

Next, transfer processing section 1 will be explained in detail as follows, referring to FIG. 2. The transfer processing section 1 of the copying machine is provided, around photoreceptor 2 which serves as an image carrier, with charging electrode 3, charge eliminating lamp (CEL) 4, developing unit 5, pre-transfer exposure lamp (PTL) 6, transfer electrode 7, separation electrode 8, separation claw 9, pre-cleaning neutralizing lamp (PCC) 10, cleaning unit 11 and pre-charging exposure lamp (PCL) 12. These are connected to control means 13 incorporated in the main body portion 102 of the copying machine 101 so that series of operations may be controlled for continuous transfer process.

In the transfer processing section 1, uniform positive charges are given to the surface of the photoreceptor 2 by means of charging electrode 3, and then light emitted from an unillustrated light source and reflected on a document is projected on the circumferential surface of the photoreceptor 2 through mirror 115, to form electrostatic latent images on the circumferential surface through neutralization on the surface corresponding to light and shade on the document. The latent images composed of positive electric charges are developed by toner having negative charge in developing unit 5, to form toner images on the surface of the photoreceptor 2. In order to avoid that toner sticks to a non-image area in the course of developing process, surface potential on the non-image area on the photoreceptor 2 is neutralized in advance by projecting light corresponding to the sheet size in charge eliminating lamp 4 located at the upperstream side of the developing unit 5.

Pre-transfer exposure lamp 6 projects light on the formed toner image to lower voltage of the latent image and thereby to reduce the force of the latent image to attract toner. When the back side of the transfer sheet 105 fed in along the guide plate 108 in synchronization with a rotation of the photoreceptor 2 is given positive charges by transfer electrode 7, toner on the circumferential surface of the photoreceptor 2 is transferred onto the transfer sheet 105. The transfer sheet 105 onto which toner images have been transferred, when it is neutralized through discharge by means of separation electrode 8, loses its force to attract the photoreceptor 2, and is guided by separation claw 9 while it is separated by its self-weight, to be separated completely, and the transfer sheet 105 is fed into fixing unit 118.

On the part of the photoreceptor 2 passing through the separation claw 9, on the other hand, there still remains untransferred toner. Therefore, pre-cleaning neutralizing lamp 10 discharges the remaining toner, like the separation electrode 8 does, to eliminate charges on the toner and the photoreceptor 2. The remaining toner whose charges have been eliminated is scraped off by cleaning unit 11, and the photoreceptor 2 thus cleaned receives uniform light from pre-charging exposure lamp 12 so that residual voltage thereon may be eliminated and uniformed for the succeeding charging.

Nest, how the cleaning unit 11 is structured will be explained in detail as follows, referring to FIGS. 3 and 4. The cleaning unit 11 is provided, inside and outside its housing 14, with cleaning means 15, sponge roller 16 and toner-transport means 17. Blade 18 equipped on the cleaning means 15 is brought into pressure contact with the circumferential surface of the photoreceptor 2 to scrape off the residual toner, and the toner thus scraped off is put on the sponge roller 16 to be dropped on feed screw 17*a* of the toner-transport means 17. The feed screw 17*a* either feeds out the toner again to developing unit 5 through an unillustrated path or feeds the toner to an unillustrated collection box for disposal.

The cleaning means 15 is provided with blade-supporting shaft 19 to which a plurality of blades 18 are affixed, supporting-shaft rotating means 20 that rotates the blade-supporting shaft 19 in the predetermined direction, and supporting-shaft moving means 21 that causes the blade-supporting shaft 19 to be in contact with or to be away from the photoreceptor 2.

The blade 18 is sandwiched and fixed by blade-holder 18*a* consisting of two metallic parts each having an L-shaped section, and is mounted rotatably on the blade-supporting shaft 19 through supporting pin 18*b*. In the present example, two blades 18 are mounted on the symmetrical positions on the blade-supporting shaft 19, but the invention is not limited thereto.

The blade-supporting shaft 19 is supported rotatably on two holder-side-plates 22*a* and 22*a* of shaft-holder 22 that constitutes a part of the supporting-shaft moving means 21. The shaft-holder 22 is provided with holder top plate 22*b* that is connected to holder side plate 22*a* and holder-rear plate 22*c*, and two pressure-contact-releasing shafts 23 and 23 are protruded from the holder top plate 22*b* at its both sides. The pressure-contact-releasing shafts 23 and 23 are supported rotatably on both side plates 14*a* and 14*a* of the housing 14 respectively. On the holder-rear plate 22*c*, there is hooked weight plate 24 which gives angular moment around the pressure-contact-releasing shaft 23 to shaft-holder 22 and blade-supporting shaft 19 so that an edge of the blade 18 may be adjusted to be in contact with the surface of the photoreceptor 2 with constant pressure.

One end of the pressure-contact-releasing shaft 23 passes through the side plate 14*a* and is connected to cam mechanism 25 that constitutes a part of the supporting-shaft moving means 21. The cam mechanism 25 is provided with arm 26 that is affixed on the end of the pressure-contact-releasing shaft 23 and constitutes a follower, cam 27 that moves the arm 26 up and down and rotates the pressure-contact-releasing shaft 23, driven gear 28 that transmits torque to the cam 27 through shaft 27*a*, driving gear 30 that is engaged with driven gear 28 through idle gear 29, and driving motor 31 that transmits torque in the predetermined direction to the driving gear 30. The driving motor 31 drives a series of supporting-shaft moving means 21 by being subjected to control of control means 13 that is built in a copying machine, and thereby the supporting-shaft moving means 21 and the blade 18 are moved selectively at three steps of a blade-contact position, a cleaning-releasing position and a blade-replacement position.

Blade-replacement-operating circuit 13*a* that is built in the control means 13 as shown in FIG. 2 operates, for blade replacement, an unillustrated driving source for the photoreceptor 2, charging electrode charge elimination lamp (CEL) 4, developing unit 5, pre-transfer lamp (PTL) 6, cleaning unit 11 and pre-charging lamp (PCL) 12, when the supporting-shaft moving means 21 arrives at the blade-replacement position.

Next, how supporting-shaft rotating means 20 that rotates blade-supporting shaft 19 in the predetermined direction for blade replacement is structured will be explained as follows. Around one end of the blade-supporting shaft 19 that protrudes toward the internal surface of side plate 14*a* of housing 14 from holder side plate 22*a* of shaft-holder 22, there is wound blade-replacement spring 33, and ratchet 34 that controls the rotation of the blade-supporting shaft 19 is affixed on its end. On the ratchet 34, there are formed cutouts in quantity identical to that of blades 18, and in the present example, there are provided two cutouts 32 corresponding to two blades 18. On the holder side plate 22*a*, there is provided claw 35 that engages with the cutout 32. Due to the ratchet 34 and the claw 35, the supporting-shaft moving means 21 can rotate the blade-supporting shaft 19 only when the supporting-shaft moving means is in a blade-isolation position.

The blade-replacement spring 33 that constitutes supporting-shaft rotating means 20 is required to have elasticity capable of turning the blade-supporting shaft 19 on which two blades 18 are affixed. The elastic force caused by the elasticity is charged by external force. For example, wire 36 is wound round on one end of the blade-supporting shaft 19 as shown in the example, and when the wire 36 is drawn out, the elastic force is charged.

Figure 5:
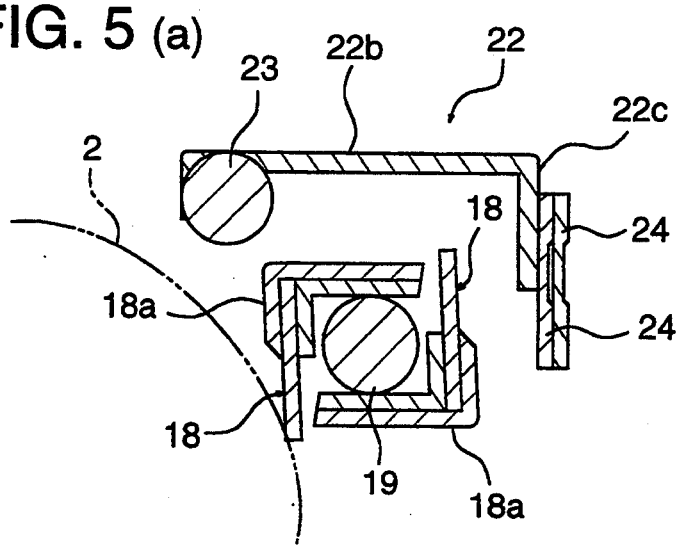
FIGS. 5(*a*)–(*c*) each represent an illustration that illustrates how swinging blade-supporting shaft and others operate.
Figure 5:
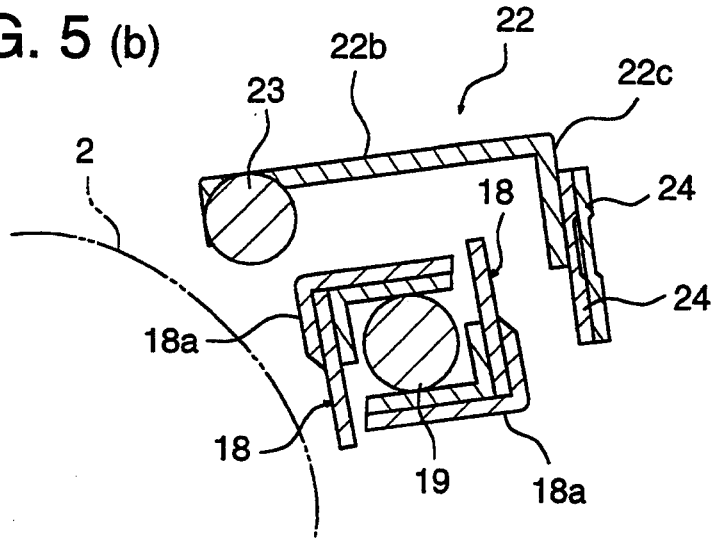
Figure 5:
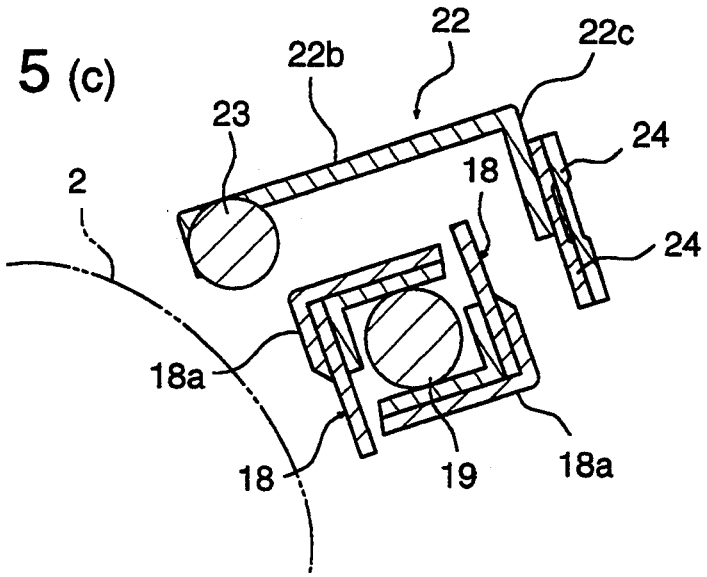

Next, how the cleaning unit 11 operates will be explained as follows, referring to FIGS. 5(*a*)–(*c*). FIGS. 5(*a*)–(*c*) each represent an illustration that explains operations of both shaft-holder 22 and blade-supporting shaft 19 which are linked with cam mechanism 25 and swing. FIG. 5(*a*) shows the supporting-shaft moving means 21 positioned in a blade-contact position, FIG. 5(*b*) shows that in a cleaning-releasing position, and FIG. 5(*c*) shows that in a blade-replacement position.

When the power source for a copying machine is turned on, control means 13 is actuated to drive driving motor 31 so that arm 26 and cam 27 may be in the non-contact state each other and blade 18 may be brought into pressure contact with the photoreceptor 2. When a predetermined period of time has passed from the completion of transfer process, control means 13 rotates cam 27 so that the cam may touch the arm 26, swings pressure-contact-releasing shaft 23 and shaft-holder 22 connected thereto corresponding to the rotated angle of the arm 26, and causes the blade 18 to be away from the photoreceptor 2 as shown in FIG. 5(*b*). In the present example, the rotated angle at the cleaning-releasing position is about 7°. Toner or paper dust sticking to blade 18 is shaken off at the cleaning-releasing position.

Cleaning means 15 usually reciprocates between the cleaning-releasing position and the blade-contact position, and when arriving at the time for blade 18 to be replaced, the control means 13 further rotates cam 27 to advance to a blade-replacement position. The rotating angle, in this case, is about 20° (FIG. 5(*c*)). Concurrently with the replacement to fresh blade conducted by supporting-shaft rotating means 20 operated at the blade-replacement position to rotate blade-supporting shaft 19 in the predetermined direction, blade-replacement-operating circuit 13*a* operates, for blade replacement, an unillustrated driving source for the photoreceptor 2, charging electrode 3, charge elimination lamp (CEL) 4, developing unit 5, pre-transfer lamp (PTL) 6, cleaning unit 11 and pre-charging lamp (PCL) 12.

Figure 6:
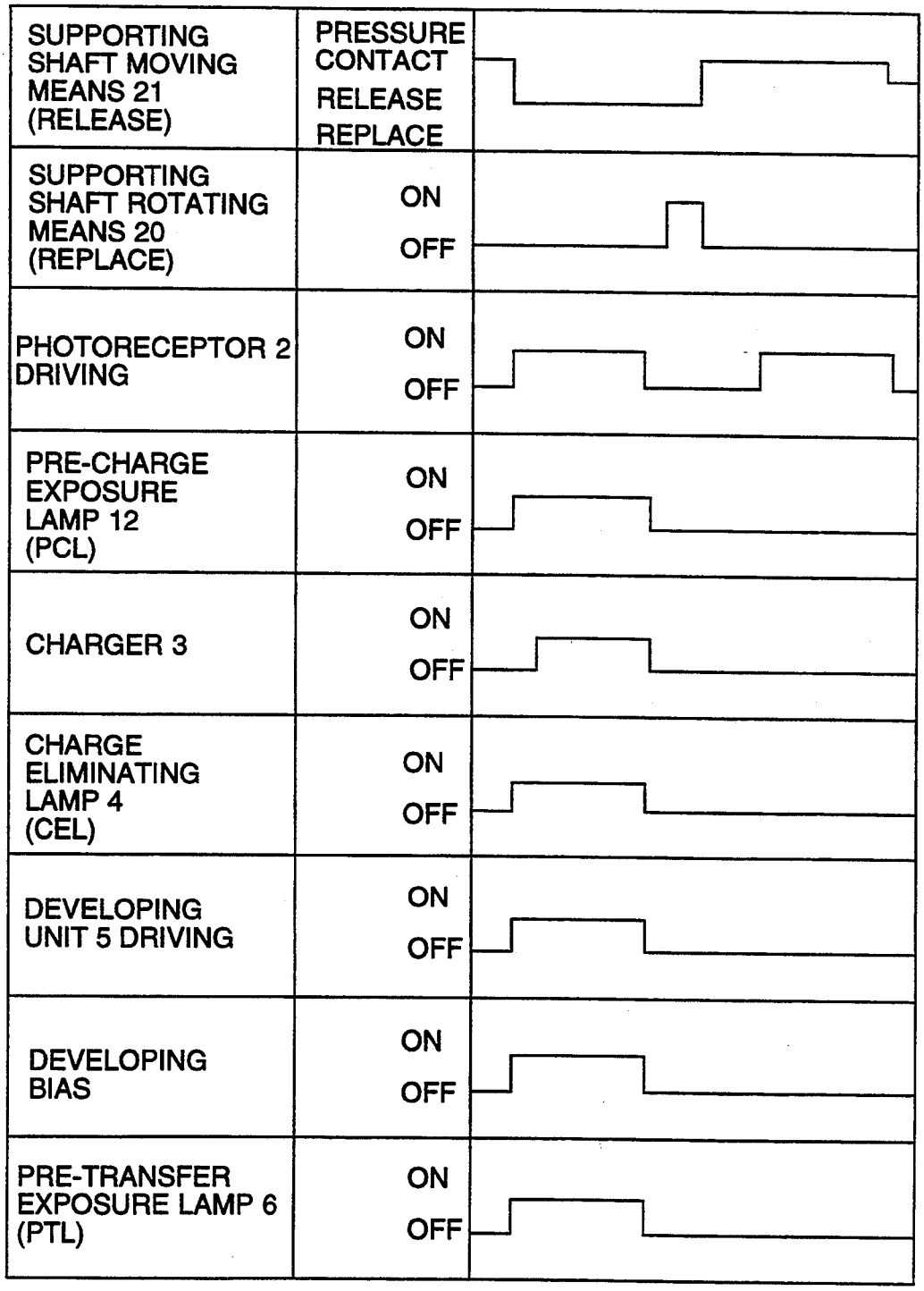
FIG. 6 is a time chart of blade replacement.

The operations mentioned above will be explained as follows, referring to a time chart shown in FIG. 6. When supporting-shaft moving means 21 moves to a blade-replacement position, the photoreceptor 2 is rotated and simultaneously with that, pre-charging lamp (PCL) 12 is turned on to eliminate and uniform residual potential, and then uniform positive charges are given by charging electrode 3 to the photoreceptor 2. Simultaneously with the foregoing, the charge elimination lamp (CEL) 4 emits light to eliminate surface potential of a non-image area on the photoreceptor 2 in advance. After that, toner that is stirred in driven developing unit 5 and is given negative charges through frictional electrification adheres to the circumferential surface of the photoreceptor 2. In this case, a developing bias is also turned on to eliminate the electric field on the background. Then, pre-transfer lamp (PTL) 6 emits light for irradiation to lower potential and thereby to reduce adhering force of the toner.

In the above-mentioned manner, toner adheres to the circumferential surface of the photoreceptor 2 and supporting-shaft rotating means 20 is turned on for changing to fresh blade 18. After that, the supporting-shaft moving means 21 moves to a blade-contact position to bring the fresh blade 18 into pressure contact with the photoreceptor 2. Under this condition, the photoreceptor 2 is driven again so that toner may adhere to the fresh blade 18. After the photoreceptor 2 makes one turn or more, the supporting-shaft moving means 21 is returned to a cleaning-releasing position, and thus, operation in blade replacement is completed.

Incidentally, though there has been explained an example of an image forming apparatus wherein a blade-supporting shaft on which a plurality of blades are attached is rotated for changing to a fresh blade, a system of a single blade to be replaced manually is also applicable without being limited to the aforementioned example, provided that toner adheres to the circumferential surface of the photoreceptor 2, interlocking with an operation of blade replacement.

In the first embodiment of the invention, as stated above, a control means is provided with a blade-replacement-operation circuit which makes toner to adhere to the entire circumferential surface of an image carrier and thereby makes a fresh blade to slide on the toner. Therefore, it is possible to reduce mutual frictional resistance between the fresh blade and a photoreceptor drum without necessity that an operator covers a blade with setting powder each time a blade is replaced, or applies toner on the photoreceptor drum. Accordingly, it is possible to simplify the blade-replacement operation.

The second embodiment of the invention is provided with a control means equipped with a blade-replacement-operation circuit. Therefore, even it is of a type to replace to a fresh blade through automatic replacement of a plurality of blades, toner applying operation that reduces frictional resistance in advance can be conducted automatically in the case of replacement to a fresh blade. Thus, it is possible to provide an image forming apparatus wherein a fresh blade is not dog-eared and thereby no insufficient cleaning caused by blade damage takes place.

Figure 7:
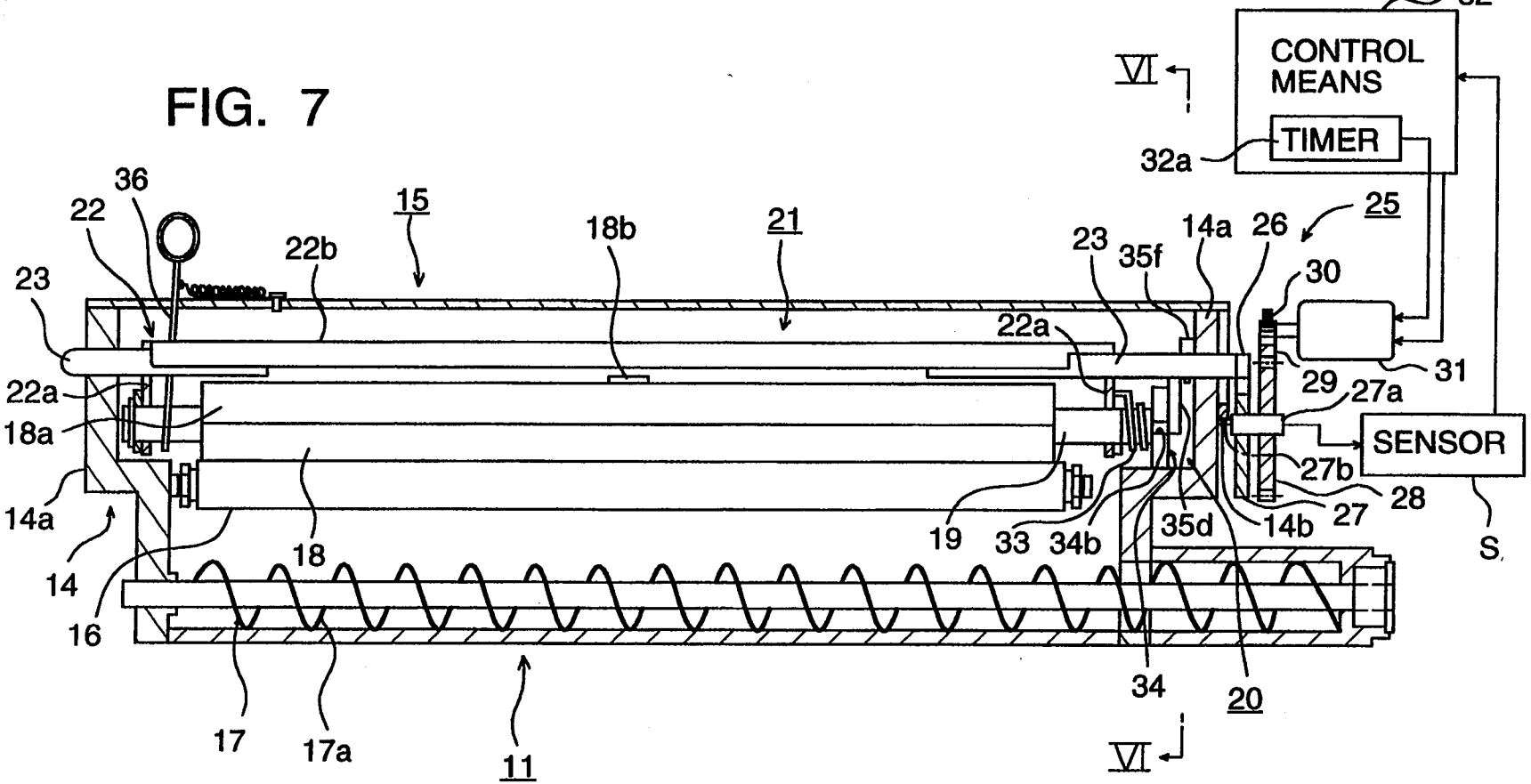
FIG. 7 is a front sectional view of a cleaning unit.

Next, other example of a cleaning device of the invention will be explained as follows, referring to the drawings attached herewith. FIG. 7 is a front sectional view of a cleaning device, FIG. 8 is a right side view of the cleaning device, and FIG. 9 is a sectional view taken on line VI—VI in FIG. 7.

Next, the structure of cleaning device 11 will be explained in detail as follows, referring to FIGS. 7–9. The cleaning device 11 is of the same structure as that in FIG. 3 mentioned above, in principle. Only the different points in terms of structure and operation, therefore, will be explained as follows. The driving motor 31 drives, being controlled by the control means 32 that is built in the copying machine, a series of supporting shaft moving means 21.

Figure 8:
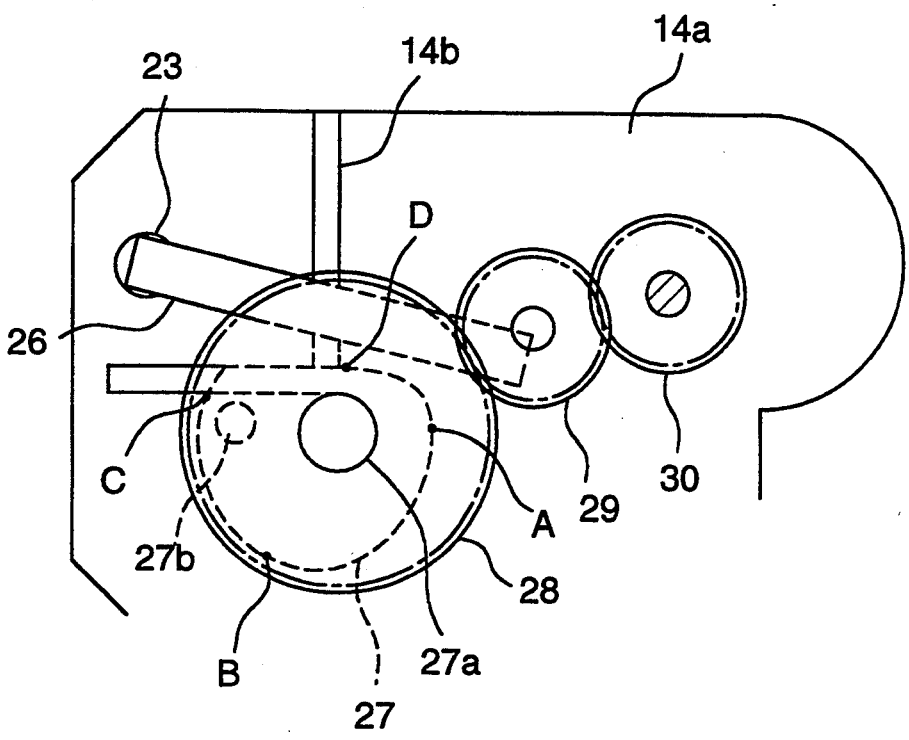
FIG. 8 is a right side view of a cleaning unit.
Figure 9:
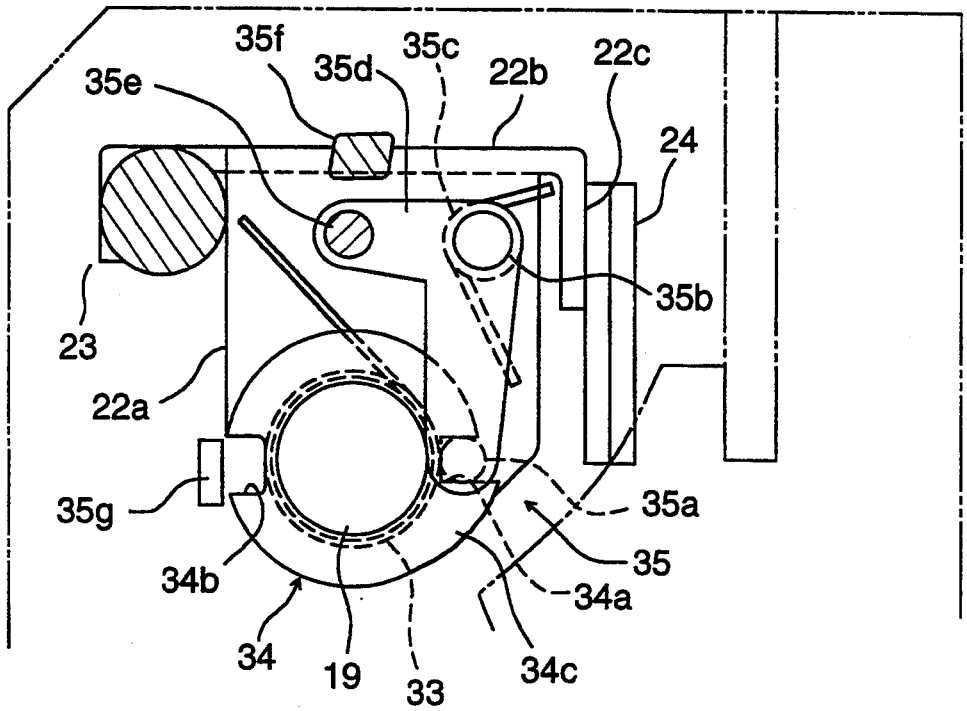
FIG. 9 is a sectional view taken on line VI—VI in FIG. 7.

As shown in FIG. 8, a cam surface of the cam 27 has thereon point A that lifts arm 26 slightly, point C that lifts the arm 26 to its maximum height, and point B on the curved surface that connects point A and point C smoothly. Point D that is on the opposite side of the point B and is between point A and point C has a radius which is too short for the cam to touch the arm 26. When the blade 18 is in contact with the circumferential surface of the photoreceptor 2, namely, when it is in a blade-contact position, the cam surface facing the arm 26 is represented by the point D, and therefore, the arm 26 and the cam 27 do not contact each other. When the blade 18 is apart from the photoreceptor 2, namely when it is in a blade-non-contact position, either one of A, B and C on the cam surface is in contact with the arm 26. Among them, point A corresponds to a non-cleaning position, while point C corresponds to a blade-replacement position. Detection of these positions is made by sensor S provided on a shaft being coaxial with that of shaft 27*a*.

Cam 27 is rotated normally to a predetermined angle by a rotation of driving motor 31. However, if it is rotated, due to its overrunning, to lift the arm 26 directly from the non-contact state (blade-contact position) to the highest point (point C), the load increases excessively to cause fear that the driving motor 31 is damaged. When it moves directly from the point C, namely a blade-replacement position to a blade-contact position, on the contrary, the blade 18 hits the photoreceptor 2, causing a possibility that the blade 18 and the photoreceptor 2 are damaged. For preventing the overrun, locking portion 27*b* in a shape of a protrusion is formed on the side of the cam 27, and rib 14*b* having the height to touch the locking portion 27*b* is provided protrusively on the outer surface of side plate 14*a* of housing 14. Even when the cam 27 rotates any direction, the cam 27 can be prevented from overrunning by the locking portion 27*b* that touches the rib 14*b* which serves as a movement-regulating member.

There will be given as follows a detailed explanation on ratchet 34 that is one of structural elements of supporting-shaft rotating means 20, referring to FIG. 9. On the ratchet 34, there are formed cutouts in the same quantity as that of blades 18, and in the present example, two cutouts 34*a* and 34*b* corresponding to two blades 18 are provided. The external circumference of the ratchet 34 is mostly on the same circle, and on the cutout 34*a* on one side, there is formed jaw portion 34*c* that is protruded from the above-mentioned circle. On side plate 22*a* of shaft-holder 22, there is provided ratchet claw 35 that is equipped with cylindrical pin member 35*a* having a size to engage with cutouts 34*a* and 34*b*. The ratchet claw 35 is provided with shaft 35*b* pivotally supported on the holder side plate 22*a*, ratchet spring 35*c* that is wound round the shaft 35*b* and urges torque in the constant direction, and L-shaped plate member 35*d* whose central portion is provided on the end of the shaft 35*b* and has on its one end the protruded cylindrical pin member 35*a* mentioned above. Due to elasticity of the ratchet spring 35*c*, the cylindrical pin member 35*a* is pushed in the cutout 34*a* so that blade-supporting shaft 19 may not be rotated by elasticity of blade-replacement spring 33 by accident.

On the other end of the L-shaped plate member 35*d*, there is provided pin member 35*e* protruding toward the side plate 14*a* of the housing 14, and on the side plate 14*a*, there is protruded stopper 35*f* above the pin member 35*e*. The stopper 35*f* presses the pin member 35*e* of ratchet claw 35 that swings together with shaft-holder 22 and causes it to stop swinging, thereby causes the ratchet claw 35 urged to swing further to swing around shaft 35*b* as a center, thus it plays a role to disengage the cylindrical pin member 35*a* from the cutout 34*a*.

Ratchet 34 on which the cylindrical pin member 35*a* has been disengaged from the cutout 34*a* swings together with blade-supporting shaft 19 due to elasticity of blade-replacement spring 33. This swing is stopped by jaw portion 34*c* of ratchet 34 that hits protrusion 35*g* provided protrusively from the holder side plate 22*a*. The protrusion 35*g* is located in a position outside the ratchet 34 where it touches only the jaw portion 34*c*. Due to the ratchet 34 and the ratchet claw 35, it is possible to rotate blade-supporting shaft 19 only when the supporting-shaft moving means 21 is in a blade-non-contact position, or in detail, when the supporting-shaft moving means 21 arrives at a blade-replacement position.

The blade-replacement spring 33 that constitutes supporting-shaft rotating means 20 is required to have elasticity capable of swinging blade-supporting shaft 19 on which two blades are affixed, and the elasticity is charged by external force. For example, wire 36 is wound round on one end of the blade-supporting shaft 19 as shown in the example, and when the wire 36 is drawn out, the elastic force is charged.

Figure 10:
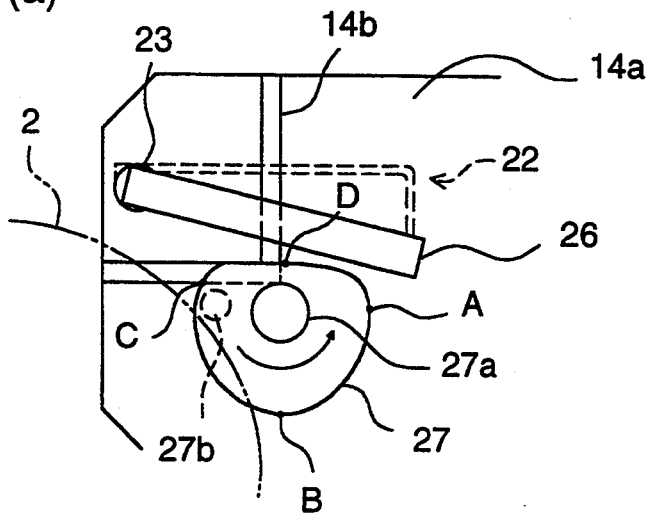
FIGS. 10(*a*)–10(*c*) are illustrations each illustrating how a cam mechanism operates.
Figure 10:
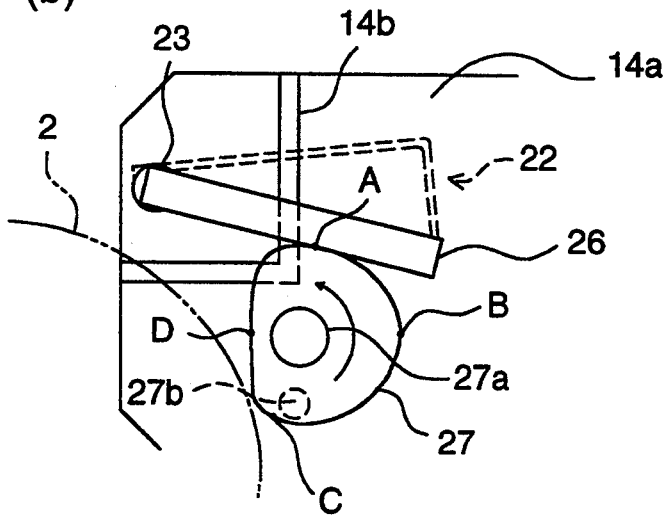
Figure 10:
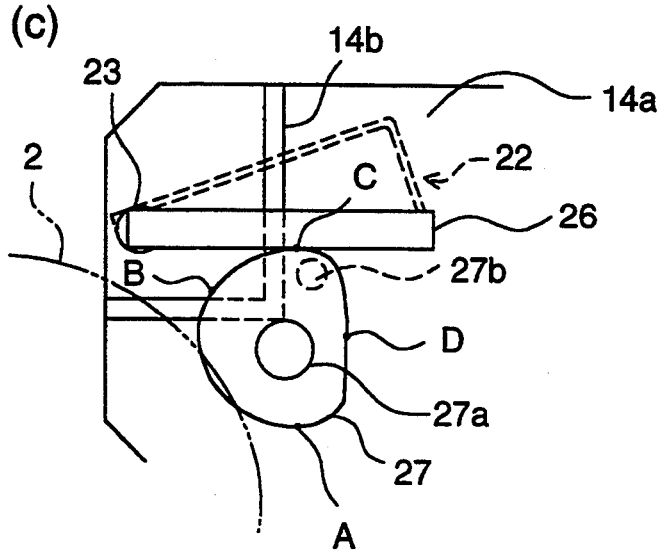

Next, how cleaning device 11 works will be explained as follows. First, how supporting-shaft moving means 21 works will be explained, referring to FIGS. 10(*a*)–10(*c*). FIGS. 10(*a*)–10(*c*) represent an illustration that illustrates how cam mechanism 25 works. FIG. 10(*a*) shows that supporting-shaft moving means 21 is in a blade-contact position, FIG. 10(*b*) shows that it is in a non-cleaning position, and FIG. 10(*c*) shows that it is in a blade-replacement position.

Cleaning means 15 usually reciprocates between the cleaning-releasing position and the blade-contact position, and when arriving at the time for blade 18 to be replaced, the control means 13 further rotates cam 27 to advance to a blade-replacement position by moving the point to contact with arm 26 from point A to point C through point B. The rotating angle, in this case, is about 20°. After the blade replacement, the cam 27 swings in the opposite direction, namely in sequence of C-B-A, and returns back to the non-cleaning position again, to bring blade 18 into pressure contact with photoreceptor 2 in the succeeding cleaning.

Figure 11:
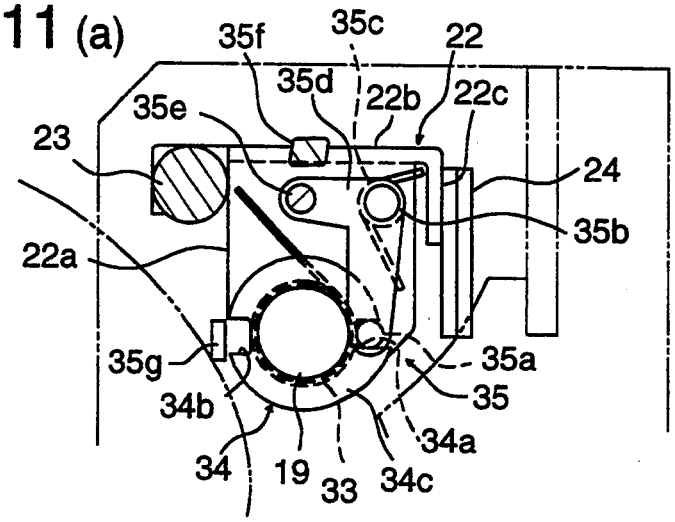
FIGS. 11(*a*)–11(*c*) are illustrations each illustrating how a supporting-shaft rotating means works.
Figure 11:
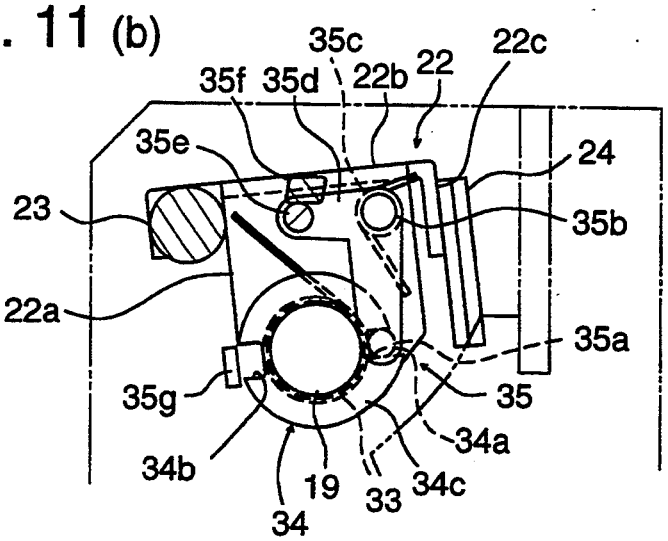
Figure 11:
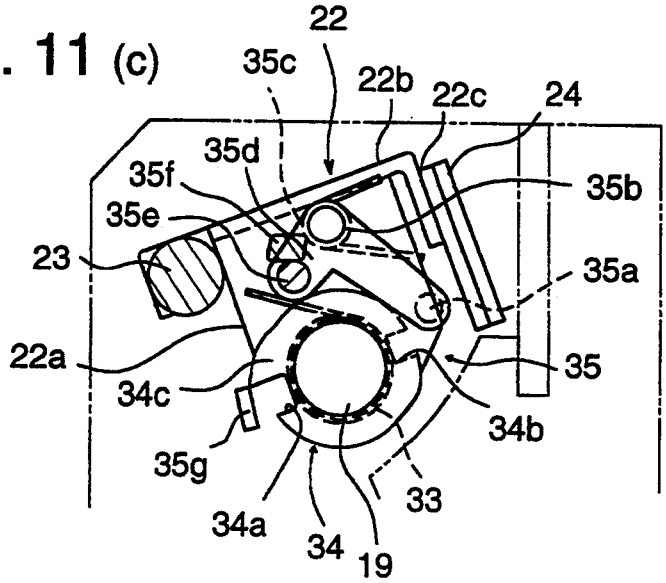

Next, operations of supporting-shaft rotating means 20 that links with supporting-shaft moving means 21 that shows the above-mentioned operations will be explained as follows, referring to FIGS. 11(*a*)–11(*c*). FIGS. 11(*a*)–11(*c*) represent an illustration that illustrates how the supporting-shaft rotating means 20 works. FIG. 11(*a*) shows that the supporting-shaft rotating means 20 is in a blade-contact position, FIG. 11(*b*) shows it is in a non-cleaning position and FIG. 11(*c*) shows it is in a blade-replacement position. When pressure-contact-releasing shaft 23 is swung by the supporting-shaft moving means 21 to a predetermined angle, stopper 35*f* protruded on side plate 14*a* of housing 14 comes in pressure contact with pin member 35*e* of ratchet claw 35 that swings together with the pressure-releasing shaft 23 and shaft-holder 22 (FIG. 11(*b*)). After that, when the pressure-releasing shaft 23 is swung further, ratchet claw 35 swings around shaft 35*b* and cylindrical pin member 35*a* is disengaged from cutout 34*a*. In this case, ratchet 34 is swung by the elasticity of blade-replacement spring 33 to the predetermined direction together with blade-supporting shaft 19. The blade 18 is replaced owing to the swing of the ratchet 34, and jaw portion 34*c* of the swinging ratchet 34 touches protrusion 35*g* provided protrusively on holder side plate 22*a* to stop the ratchet 34 (FIG. 11(*c*)). After that, when the supporting-shaft moving means 21 swings pressure-releasing shaft 23 to the opposite direction and returns to the non-cleaning position, shaft 35*b* is rotated by elasticity of ratchet spring 35*c* in the fixed direction to engage cylindrical pin member 35*a* with cutout 34*b* of the ratchet 34, thus, positioning of blade 18 is completed.

Figure 12:
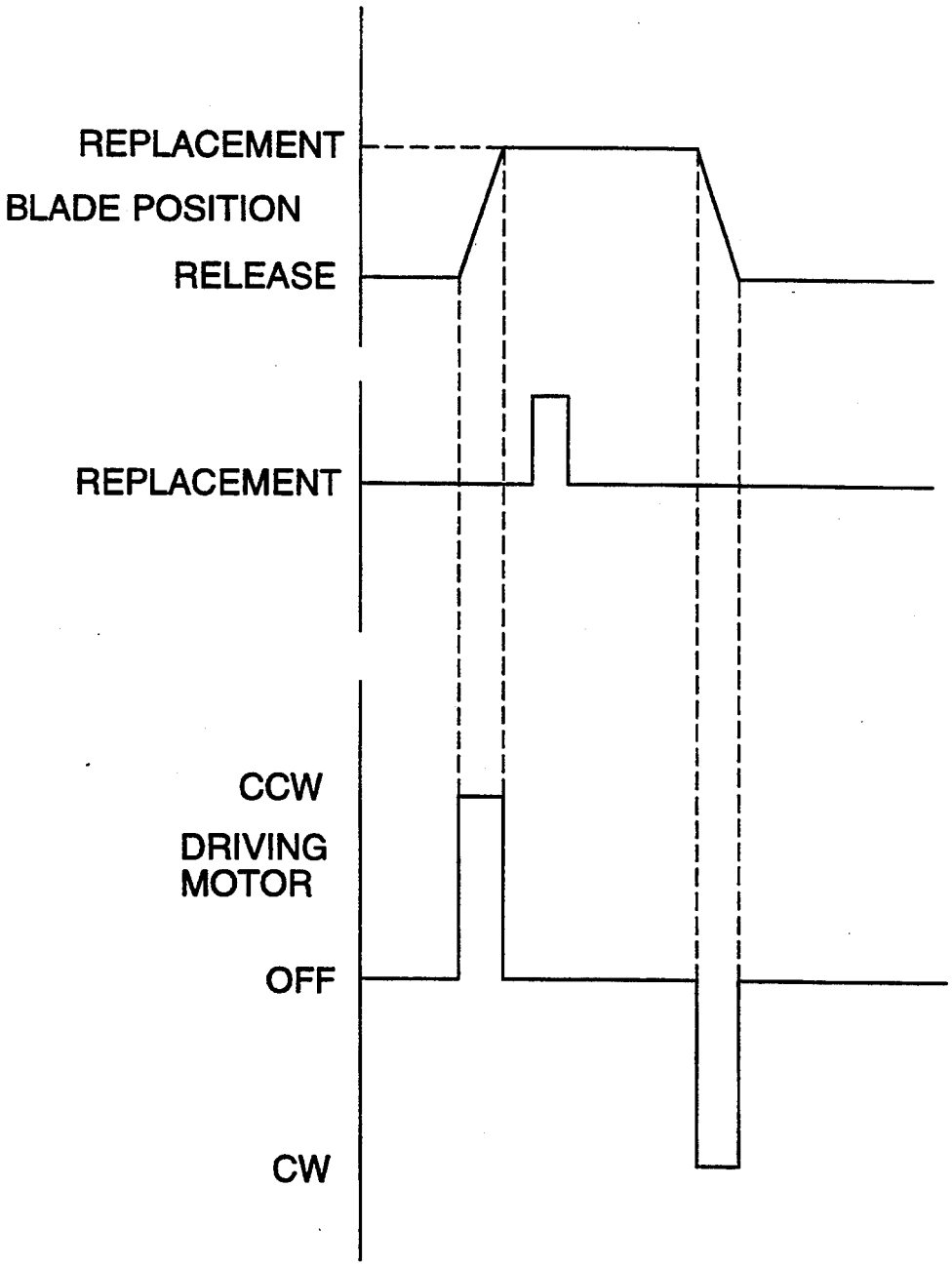
FIG. 12 is a time chart for a supporting-shaft moving means.

When the supporting-shaft moving means 21 is returned from a blade-replacement position to a non-cleaning position, timer 32*a* provided in control means 32 counts a period of time required to calm the toner blown up in the course of blade replacement in cleaning device 11. A time chart relating to this is shown in FIG. 12. In the present example, a period of time for waiting at a blade-replacement position is 8 seconds. Within this waiting period, the toner blown up when blade-supporting shaft 19 rotates can be calmed. Thus, even when the supporting-shaft moving means 21 is returned to a non-cleaning position, there is no fear that toner blown up scatters outside the cleaning device 11.

As stated above, in the third embodiment of the invention, there is provided a supporting-shaft rotating means which is equipped with a supporting-shaft moving means capable of moving a blade between a blade-contact position and a blade-non-contact position against an image carrier, and rotates a blade-supporting shaft when being in the blade-non-contact position. Therefore, even when the blade-supporting shaft is rotated for replacement of a blade, there is no fear that the image carrier and a blade are damaged.

In the fourth embodiment of the invention, a blade-non-contact position is represented by two steps including a non-cleaning position and a blade-replacement position, and there is provided a rotation control means that rotates a blade-supporting shaft only when the supporting-shaft moving means arrives at the blade-replacement position. Therefore, it is possible to discriminate non-cleaning timing and blade-replacement timing clearly, resulting in no fear that a blade is replaced unnecessarily by accident.

In the fifth embodiment of the invention, there is provided a cam mechanism equipped with a movement-regulating member that is provided with a cam surface covering from a blade-contact position to a blade-replacement position through a non-cleaning position and prevents the use of a cam surface connecting the blade-replacement position and the blade-contact position directly. Therefore, it is possible to prevent that the load applying on the cam mechanism increases excessively and to prevent that a blade hits an image carrier abruptly to damage the blade and the image carrier.

In the sixth embodiment of the invention, there is provided a timer capable of controlling so that the blade which has replaced the used one may be returned to a non-cleaning position after a predetermined period of time. Therefore, it is possible to calm, in a cleaning device, the toner blown up in the course of blade replacement and to prevent that the toner scatters to the outside of the cleaning device.

Figure 13:
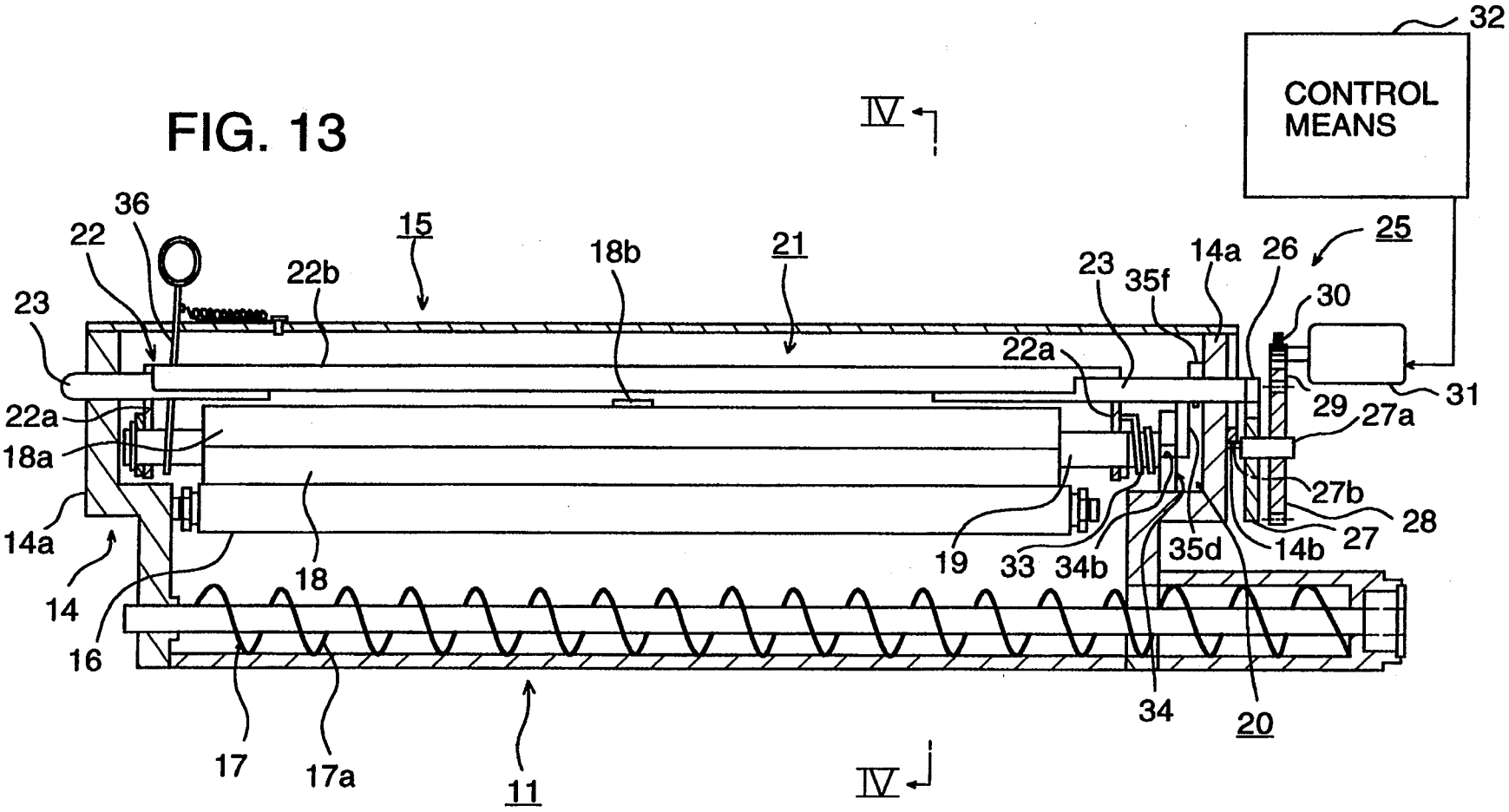
FIG. 13 is a front sectional view of a cleaning unit.

Next, another example of a cleaning device of the invention will be explained as follows, referring to the drawings attached herewith. FIG. 13 is a front sectional view of a cleaning device and FIG. 14 is a sectional view taken on line IV—IV in FIG. 13.

Next, how cleaning device 11 is structured will be explained in detail, referring to FIGS. 13 and 14. In principle, the cleaning device 11 is the same as that in FIG. 3 in structure. Different points in terms of structure and operation only will be explained, accordingly. A clearance between housing 14 and cleaning means 15 is blocked with sealing member 50 so that the toner dropped from sponge roller 16 may not scatter to the outside of the housing 14.

Figure 14:
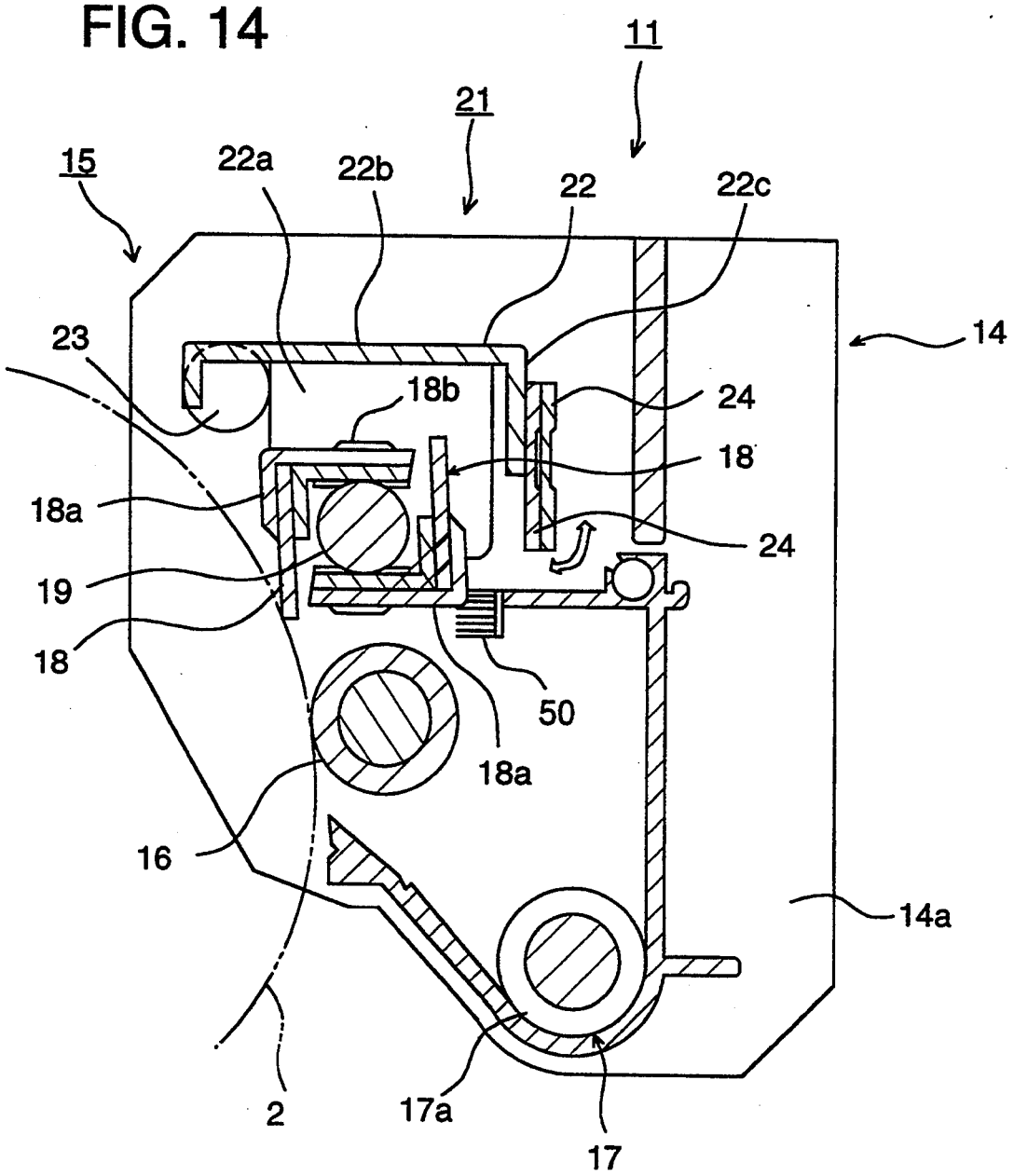
FIG. 14 is a sectional view taken on line IV—IV in FIG. 13.

Blade-holder 18*a* for blade 18 shown in FIG. 14 is sealed by sealing member 50 in a manner that the entire length in the longitudinal direction of the blade-holder is covered by the sealing member. A material of the sealing member 50 is selected so that the sealing member can deform elastically, following the behavior of the blade-holder 18*a*. As shown in FIG. 13, driving motor 31 drives a series of swinging means of supporting-shaft moving means 21, being controlled by control means 32 that is built in a copying machine.

Figure 15:
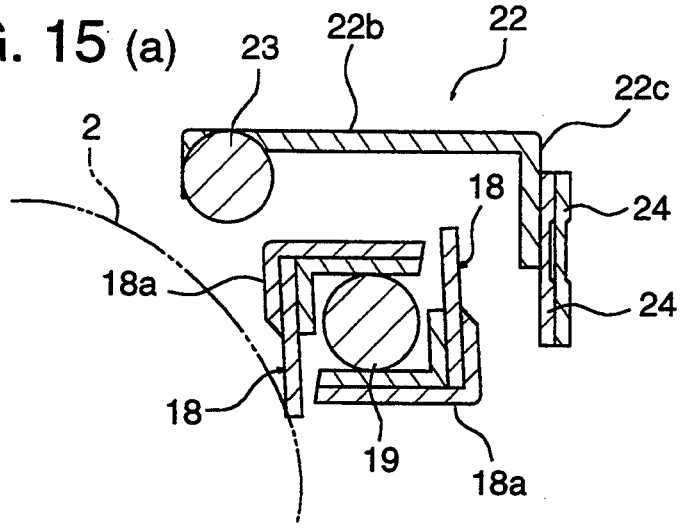
FIG. 15(*a*)–15(*c*) illustrate operations of a blade-supporting shaft or the like which swing through linkage with a cam mechanism.
Figure 15:
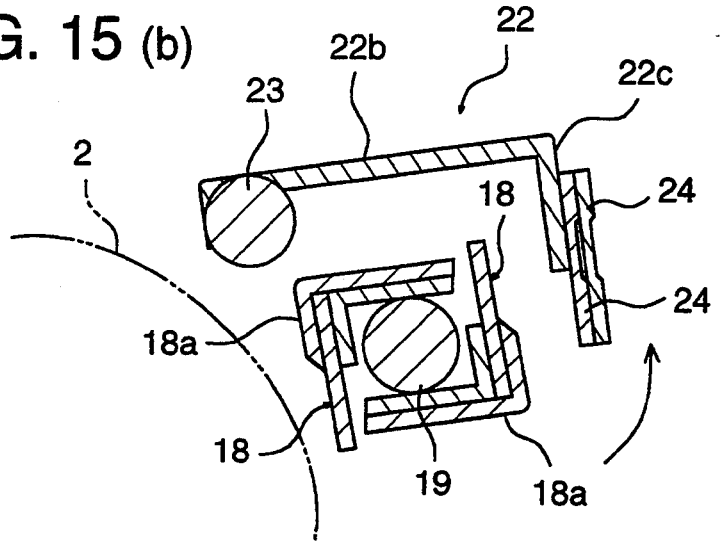
Figure 15:
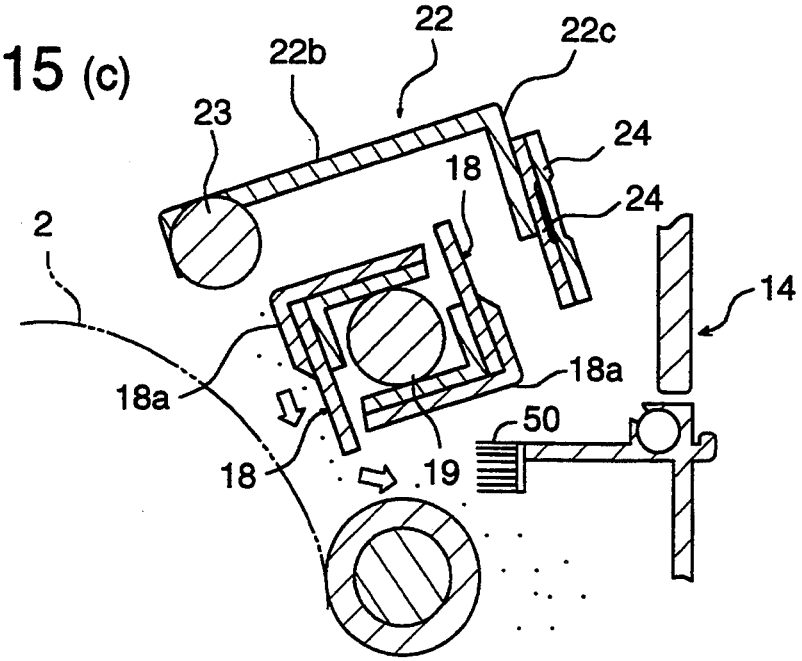

Next, how cleaning device works will be explained. First, how supporting-shaft moving means 21 works will be explained, referring to FIGS. 15(*a*)–15(*c*). FIGS. 15(*a*)–15(*c*) represent an illustration that illustrates the operations of shaft-holder 22 and blade-supporting shaft 19 both swing through linkage with cam mechanism 25. FIG. 15(*a*) shows that supporting-shaft moving means 21 is in a blade-contact position, FIG. 15(*b*) shows that it is in a non-cleaning position, and FIG. 15(*c*) shows it is in a blade-replacement position.

Cleaning means 15 usually reciprocates between the cleaning-releasing position and the blade-contact position, and when arriving at the time for blade 18 to be replaced, the control means 13 further rotates cam 27 to advance to a blade-replacement position by moving the point to contact with arm 26 from point A to point C through point B. A locus of the swing of the cleaning device in a period mentioned above is on a circular arc whose center is on pressure-releasing shaft 23. At the blade-replacement position, supporting-shaft rotating means 20 rotates blade-supporting shaft 19 in the direction identical to that of the locus of the swing from a non-cleaning position to a blade-replacement position. Therefore, toner sticking to the used blade and to blade-holder 18*a* is shaken off in the direction of a rotation of the blade-supporting shaft 19, namely in the direction toward the inside of housing 14, thus, it is possible to prevent that toner scatters to the outside of cleaning device 11.

As shown in FIGS. 11(*a*)–11(*c*) and FIGS. 15(*a*)–15(*c*), when a rotation of blade-supporting shaft 19 caused by blade-replacement spring 33 is insufficient slightly, cutout 34*b* and cylindrical pin member 35*a* do not agree with each other in terms of position. Therefore, it is impossible to lock. In the cleaning device 11, however, when cleaning means 15 is swung and returned to a non-cleaning position after blade replacement, blade-supporting shaft 19 receives torque in the direction opposite to its swinging direction because of frictional force caused by blade-holder 18*a* and sealing member 50 which contact and slide each other. Since this direction of the torque is the same as that of a rotation of blade-supporting shaft 19, the rotation angle of shortage, namely the angle for jaw portion 34*c* to rotate to protrusion 35*g* can be compensated.

As stated above, in the seventh embodiment of the invention wherein an elastic member is used as a driving source for a supporting-shaft rotating means, it is possible to rotate a blade-supporting shaft with elasticity of a simple device, which may also contribute to miniaturization of a device.

In the eighth embodiment of the invention wherein a supporting-shaft rotating means is provided with positioning members and locking members corresponding to a plurality of blades, it is possible to position and lock accurately on the occasion of blade replacement even when an elastic member is used as a driving source for rotation of a blade-supporting shaft.

In the ninth embodiment of the invention wherein a blade-supporting shaft is provided with an elastic member that urges the blade-supporting shaft to rotate with torque whose direction is opposite to that of swinging back from a blade-replacement position to a non-cleaning position, toner is shaken off in the direction of rotation of the blade-supporting shaft, namely in the direction toward the inside of a housing, making it possible to prevent that toner scatters outside.

In the tenth embodiment of the invention wherein a housing is equipped with a sealing member that makes frictional contact with a blade-holder at a non-cleaning position, even when there is shortage of rotation of a blade-holder on the occasion of blade replacement, the blade-holder receives torque in the direction opposite to its rotation, assuring sure positioning.

Figure 16:
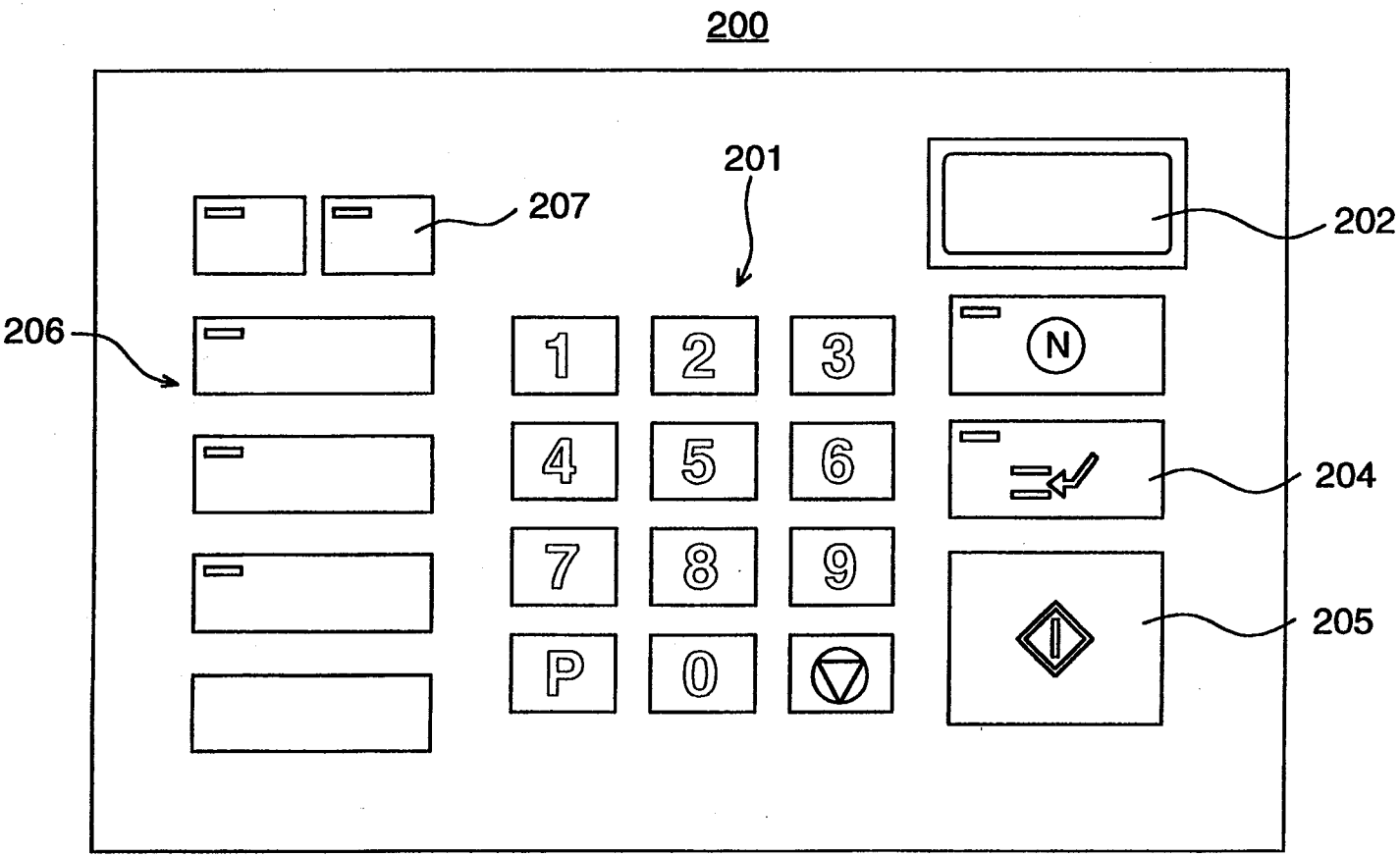
FIG. 16 is a top view of an operation section of an image forming apparatus.
Figure 17:
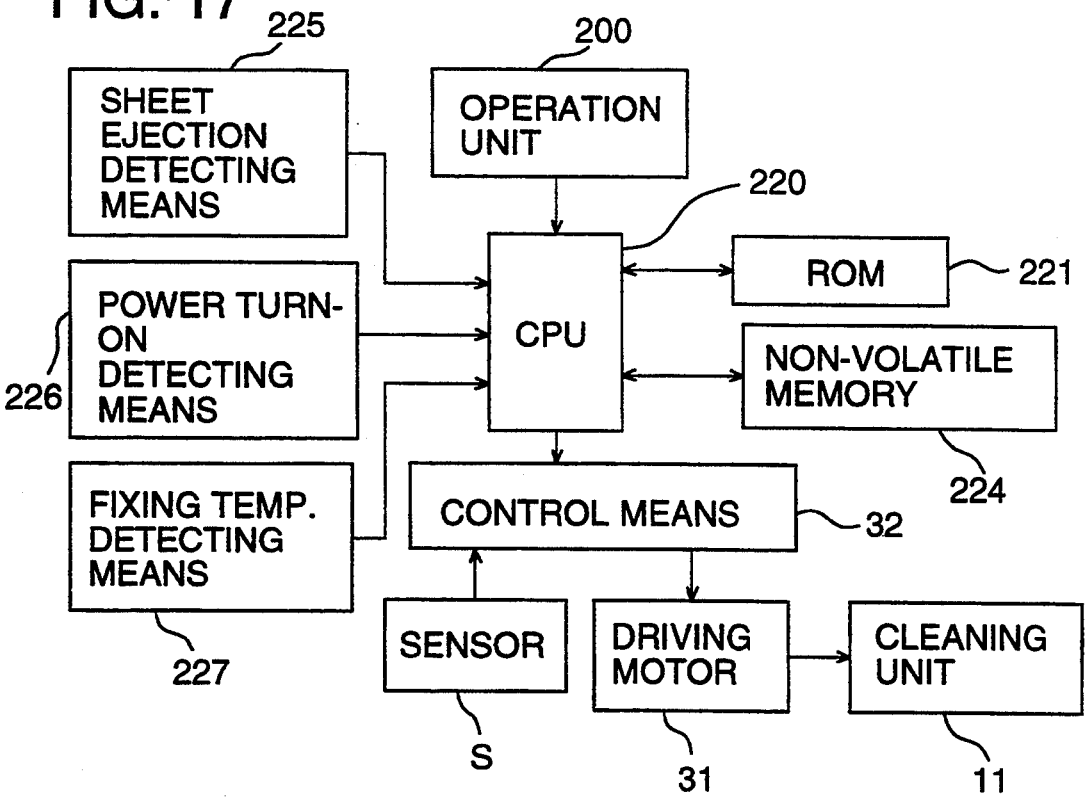
FIG. 17 is a block diagram of an image forming apparatus.

Next, still another example of a cleaning device of the invention will be explained as follows, referring to the drawings attached herewith. First, there will be explained about replacement timing for a blade of a cleaning unit shown in the above-mentioned FIG. 7 in the present cleaning device. FIG. 16 is a top view of an operation panel of an image forming apparatus and FIG. 17 is a block diagram of the image forming apparatus. Depending on an amount of residual toner affected by how the image forming apparatus is used, the durability of blade 18 varies. Further, when a plurality of blades are used as in this case, for example, the durability of a blade 18 that is set later is shortened by a degree of deterioration of its usage conditions affected by toner mixed with paper dust which is caused by the blade 18 used previously. The durability of blade 18 also varies depending on itself. In view of the foregoing, it is possible to replace a blade depending on how the blade has been used.

In the top view in FIG. 16 of an operation panel of an image forming apparatus, at the central portion of operation panel 200, there is arranged ten-key 201 through which the number of copies and others are inputted. On the right hand side of the ten-key 201, there are provided copy quantity display 202, interruption display 204 and copy button 205. On the left hand side, there are provided display of copy magnification 206 and mode selection button 207.

The power source is turned on through operation of an unillustrated power switch button, and a blade-replacement timing input mode is selected through operation of mode selection button 207. Ten-key 201 at the central portion is used for inputting blade-replacement timing in addition to copy quantity, and the ten-key 201 constitutes a blade-replacement timing input means through which the blade-replacement timing can be inputted.

In an image forming apparatus in FIG. 17, information from operation panel 200 is inputted into CPU 220 which takes charge of copy sequence through a program stored in ROM 221. Further, the CPU 220 controls control means 32 which drives driving motor 31 that conducts pressure contact, non-cleaning and replacement of the blade 18 and it is also a driving source for cleaning unit 11. The control means 32 operates after receiving signals for pressure contact, non-cleaning or replacement of the blade 18 from the CPU 220, and outputs signals of in process of blade replacement to the CPU 220. Into the CPU 220, there is inputted from sensor S information for learning pressure contact, non-cleaning and replacement position of the blade 18, and the driving motor 31 is driven based on the information from the sensor 31.

When the replacement timing for blade 18 is inputted through operation of ten-key 201 on operation panel 200, the replacement timing is stored in non-volatile memory 224 through CPU 220, and the non-volatile memory 224 constitutes a rewritable memory means in which the replacement timing inputted from a replacement timing input means is stored. Further, into the CPU 220, there are inputted detection information from sheet ejection detecting means 225 that detects the ejection of a transfer sheet onto which toner images have been transferred to the outside of apparatus main body 102, power turn-on detecting means 226 that detects power turn-on for apparatus main body 102, and fixing temperature detecting means 227 for a fixing unit that detects fixing temperature which makes the apparatus main body 102 possible to operate. Therefore, it is detected that temperature of a fixing unit arrives at the temperature suitable for fixing (for example, 200° C.), and signals telling the readiness for copying are displayed.

Figure 18:
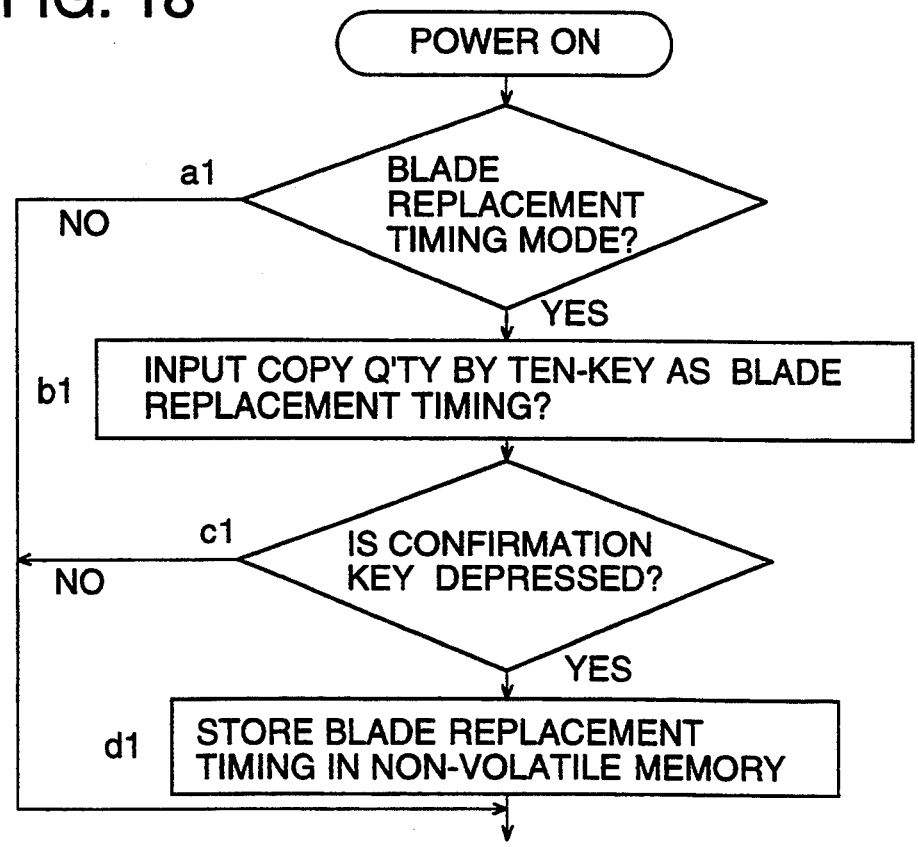
FIG. 18 is a flow chart for inputting the timing of blade replacement.

On a control means constituted with CPU 220, the replacement timing stored in a memory means makes it possible to replace blade 18, and input of the replacement timing for the blade 18 will be explained as follows, referring to the flowchart in FIG. 18.

After the power source is turned on through operation of an unillustrated power switch button, a mode is judged whether it is a blade-replacement timing input mode or not in step a1, and when the blade-replacement timing input mode is selected by mode selection button 207, a copy quantity is inputted by ten-key 201 as the blade-replacement timing in step b1. In step c1, it is judged whether a confirmation key is inputted or not, and when the confirmation key is inputted, the blade-replacement timing is stored in non-volatile memory 224 in step d1. The confirmation key is a key for confirming whether it is allowed to write a figure showing the blade-replacement timing inputted by the ten-key 201 in the non-volatile memory 224 or not, and, for example, copy button 205 is used for that purpose.

Depending on an amount of residual toner affected by how the image forming apparatus is used, the durability of blade 18 varies. Further, when a plurality of blades are used as in this case, for example, the durability of a blade 18 that is set later is shortened by a degree of deterioration of its usage conditions affected by toner blown up due the blade 18 used previously. The durability of blade 18 also varies depending on itself. In view of the foregoing, it is possible to prevent insufficient cleaning and to solve the problem that the blade 18 which is still usable is replaced by accident, by making it possible to replace a blade depending on how the blade has been used.

Next, the blade-replacement timing for the blade which has been used after being set in the aforementioned manner will be explained as follows, referring to flowcharts in FIGS. 19–21. After arriving at the replacement timing of the blade 18, what is a problem is to determine the replacement timing that justifies the replacement of the blade, taking the state of an image forming apparatus into consideration. It is necessary to consider so that the replacement of the blade 18 may cause no soiling of a transfer sheet, no adverse affect on the apparatus and no loss of time.

First, on a control means constituted by CPU 220, after sheet ejection detecting means 225 detects that a transfer sheet having thereon transferred toner images has been ejected to the outside of apparatus main body 102, the replacement timing stored in non-volatile memory means 224 which is a memory means makes it possible to replace blade 18, and it is possible prevent that a transfer sheet remains in the apparatus main body 102 in the case of replacement of blade 18 and thereby to prevent soiling of a transfer sheet and an adverse affect on the apparatus.

Figure 19:
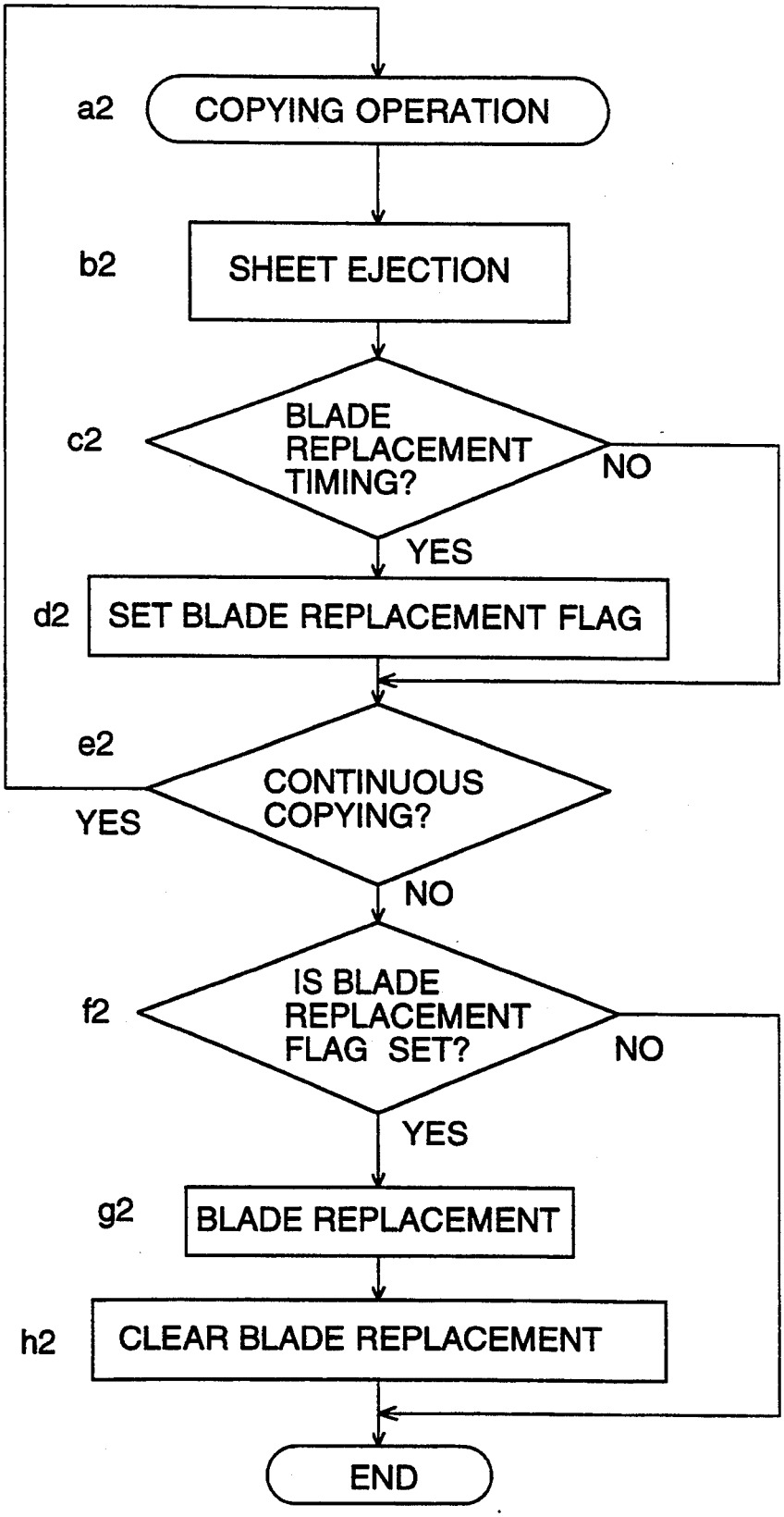
FIG. 19 is a flow chart for the timing of blade replacement.

When replacing blade 18 according to the flowchart in FIG. 19, copy operation is made in step a2, a transfer sheet is ejected in step b2, and then judgment is made whether it is replacement timing or not in step c2. When the timing is already for replacing a blade, a blade-replacement graph is set in non-volatile memory 224 in step d2, an judgment is made whether copying is continuous copying or not in step e2. When the timing is not for replacing blade 18 in step c2, the sequence goes to step e2 for judging whether copying is continuous copying or not.

In the case of continuous copying in step e2, the sequence goes to step a2, and when the copying is not continuous copying, it is judged whether a blade-replacement graph is set in non-volatile memory 224 or not in step f2, and when it is set, a blade is replaced in step g2. For the blade replacement, driving motor 31 moves blade 18 to the blade-replacement position, and it stops there for a certain period of time until the blade has been replaced, and then, it further moves the blade to a non-cleaning position. After the completion of the blade replacement, the blade-replacement graph is erased in step h2, thus the blade replacement is finished.

Next, on the control means constituted with CPU 220, after power turn-on detecting means 226 detects that the power source has been turned on for apparatus main body 102, the replacement timing stored in a memory means of non-volatile memory 224 makes it possible to replace blade 18, and time for replacing blade 18 is not provided in particular due to utilization of warm-up time T1 after detection of power turn-on. Therefore, it is possible to replace blade 18 without causing time loss.

Figure 20:
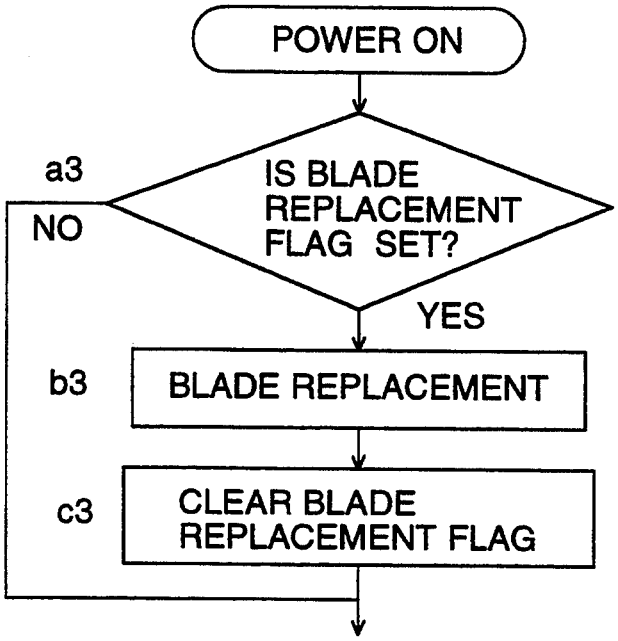
FIG. 20 is a flow chart for the timing of blade replacement.

When replacing blade 18 according to the flowchart in FIG. 20, after the power source is turned on for apparatus main body 102, judgment is made in step a3 whether a blade-replacement graph is set in non-volatile memory 224 or not, and when the blade-replacement graph is set, a blade is replaced in step b3. For the blade replacement, driving motor 31 moves blade 18 to a blade-replacement position as stated above, and it stops there for a certain period of time until the blade has been replaced, and then, it further moves the blade to a non-cleaning position. After the completion of the blade replacement, the blade-replacement graph is erased in step c3, thus the blade replacement is finished.

Further, on the control means constituted with CPU 220, fixing temperature K1 inputted from temperature detecting means 227 for a fixing unit which detects the fixing temperature enabling apparatus main body 102 to operate is compared with established temperature K2. Namely, when the current fixing temperature K1 of the fixing unit is not more than the established temperature K2 (for example, 150° C.), the time (for example, 10 seconds) required for raising up to fixable temperature K3 (for example, 200° C.) is established as warm-up time T1. When the warm-up time T1 is longer than time T2 required for replacement of blade 18 after comparison, the replacement timing stored in a memory means of non-volatile memory means 224 makes it possible to replace the blade 18, and no special time for replacement of blade 18 is provided. Therefore, it is possible to replace blade 18 without causing time loss.

As stated above, a temperature detecting means is used as a substitute for a means that detects the time and compares, and the established temperature K2 and the fixable temperature K3 are set in advance on an image forming apparatus in a factory before its shipment, and they can not be changed in the field.

Figure 21:
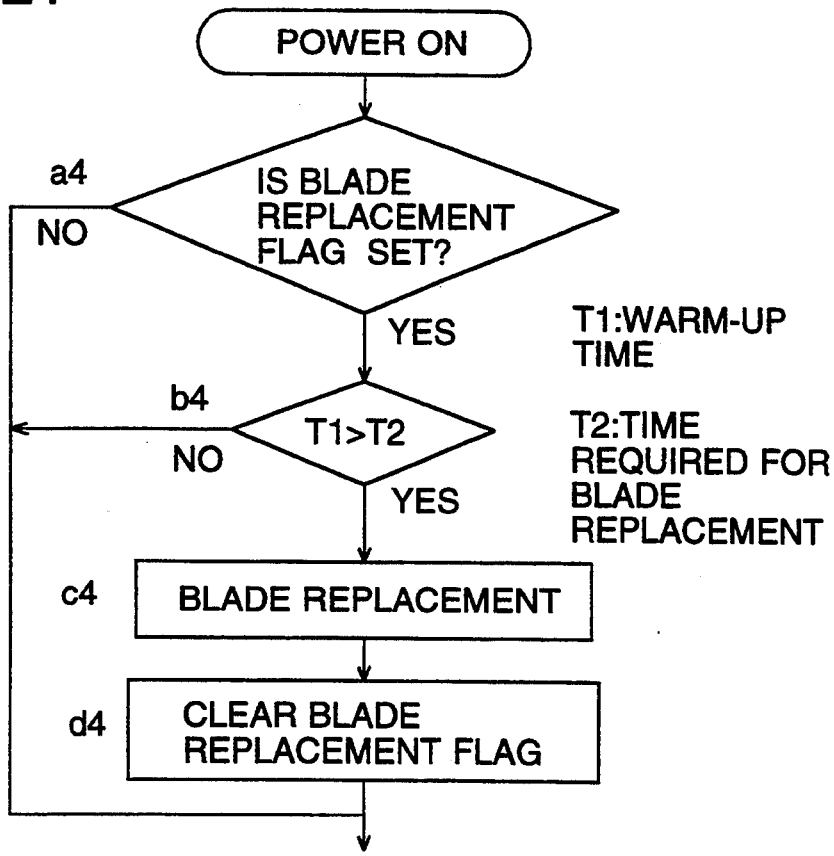
FIG. 21 is a flow chart for the timing of blade replacement.

When replacing blade 18 according to the flowchart in FIG. 21, after the power source is turned on for apparatus main body 102, judgment is made in step a4 whether a blade-replacement graph is set in non-volatile memory 224 or not, and when the blade-replacement graph is set, time T2 required for blade replacement is compared with warm-up time T1, and the warm-up time T1 is longer, a blade is replaced in step c4. For the blade replacement, driving motor 31 moves blade 18 to a blade-replacement position as stated above, and it stops there for a certain period of time until the blade has been replaced, and then, it further moves the blade to a non-cleaning position. After the completion of the blade replacement, the blade-replacement graph is erased in step d4, thus the blade replacement is finished.

As stated above, in the eleventh embodiment of the invention, blade replacement timing is inputted by means of a replacement timing input means, the replacement timing from the replacement timing input means is stored in a rewritable memory means, replacement timing for a blade is freely established, and a blade can be replaced at the replacement timing established by the control means. Therefore, it is possible to replace a blade appropriately based on how the blade has been used, and thereby to prevent that insufficient cleaning is caused and a blade which is still usable is replaced by accident wastefully.

In the twelfth embodiment of the invention, a sheet ejection detecting means detects that a transfer sheet having thereon transferred toner images has been ejected to the outside of an apparatus main body, and after the detection by means of the sheet ejection detecting means, a blade can be replaced at the replacement timing established by the control means. Therefore, it is possible to replace a blade without stopping copying operation.

After the detection of power turn-on for an apparatus main body by means of a replacement timing inputting means which is a power turn-on detecting means in the thirteenth embodiment of the invention, and after power turn-on for an apparatus main body in the fourteenth embodiment, judgment is made on whether the fixing temperature of a fixing unit is one enabling a blade to be replaced or not, to make it possible to replace a blade at the replacement timing established when a warm-up time necessary to go from the current temperature to the temperature that makes it possible to fix is longer. Therefore, the warm-up time is utilized and no special time for replacing a blade is provided. Accordingly, it is possible to replace a blade without any loss of time.

Figure 22:
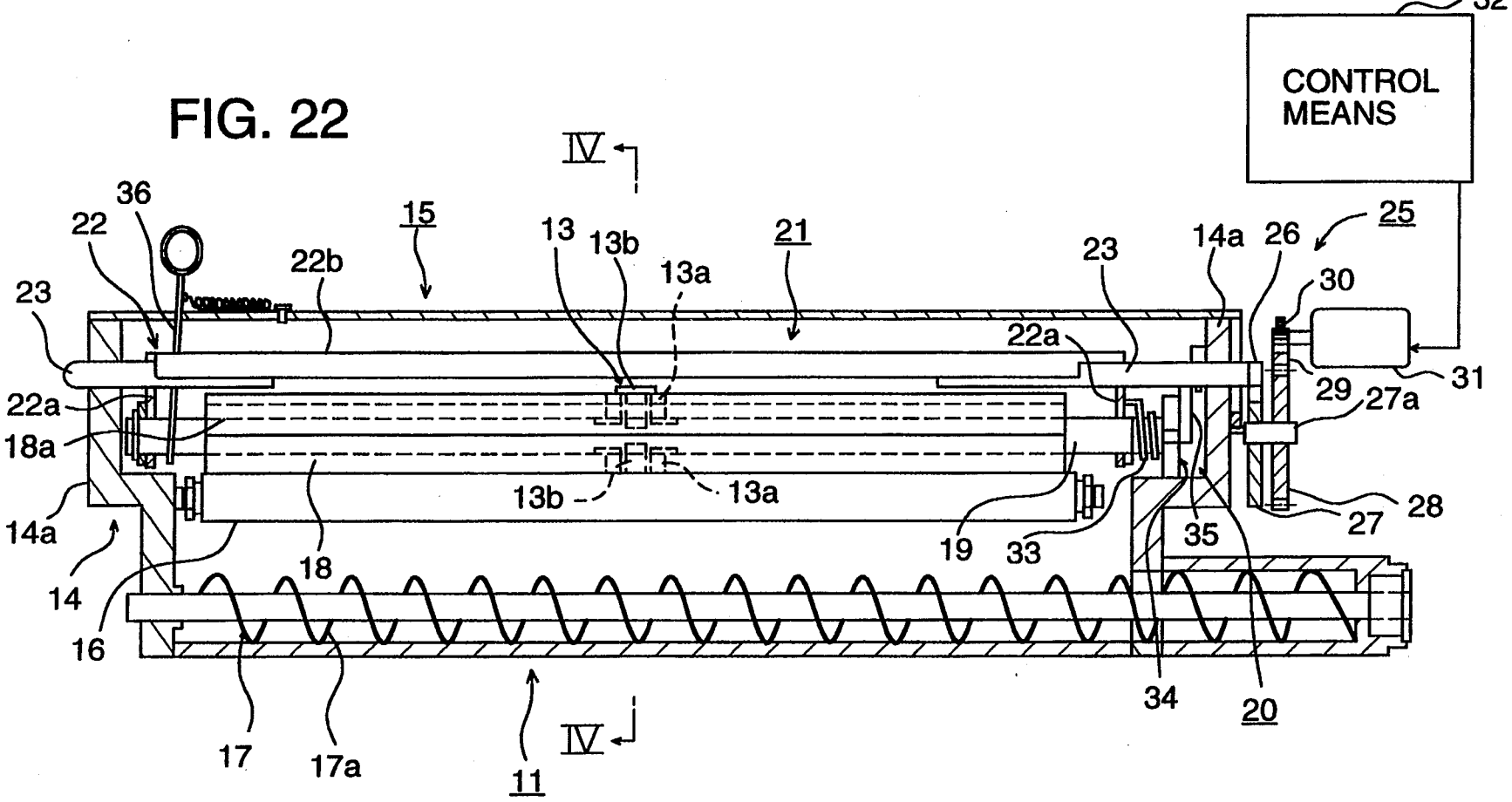
FIG. 22 is a front sectional view of a cleaning unit.
Figure 23:
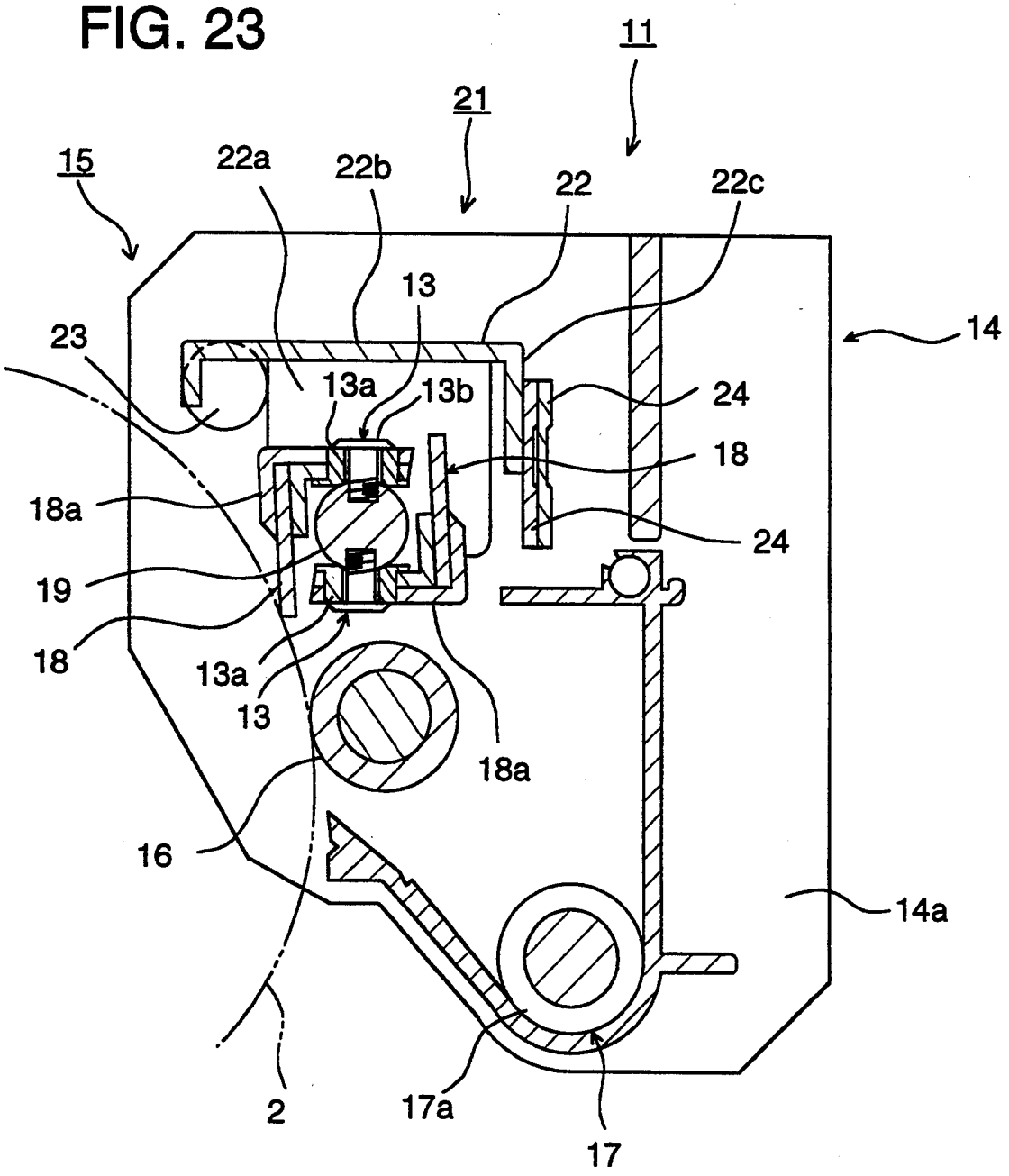
FIG. 23 is a sectional view taken on line IV—IV in FIG. 22.
Figure 24:
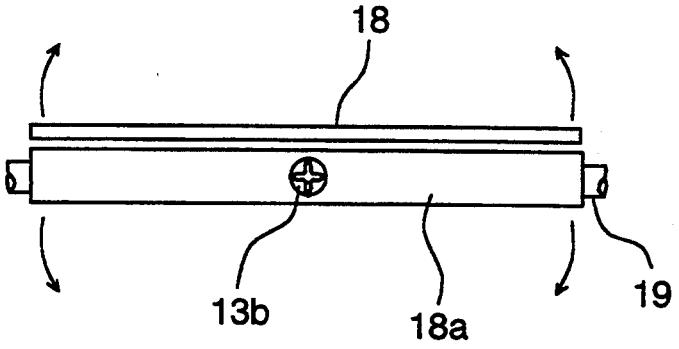
FIG. 24 is a top view of a portion where a blade is affixed.

Next, further example of a cleaning device of the invention will be explained as follows, referring to the drawings attached herewith. FIG. 22 is a front sectional view of a cleaning unit, FIG. 23 is a sectional view taken on line IV—IV in FIG. 22, and FIG. 24 is top view of a blade-affixing portion.

Next, the structure of cleaning unit 11 will be explained in detail as follows, referring to FIGS. 22 and 23. The cleaning unit 11 is the same as that in FIG. 7 mentioned above in principle. Therefore, different points in terms of structure and operation will be explained as follows.

Blade 18 is interposed between two metal fittings each having L-shaped section to be affixed by blade-holder 18*a* which is mounted on blade-supporting shaft 19 so that the blade-holder may swing around supporting member 13. The supporting member 13 has thereon bearing member 13*a* provided internally at the central portion of the blade-holder 18*a* and shaft member 13*b* that passes through the bearing member 13*a* to support the blade-holder 18*a* and is screwed in the blade-supporting shaft at its one end. In the present example, two blades 18 are affixed at symmetrical positions on the blade-supporting shaft 19. In this case, the blades 18 are supported in a manner that they can swing around the shaft member 13*b* as shown in FIG. 24. Therefore, the blades are in parallel to the circumferential surface of photoreceptor 2 and thereby scrape off residual toner with a uniform pressure.

Supporting-shaft rotating means 20 is provided with blade-replacement spring 33 that is wound round one end of blade-supporting shaft 19 and with ratchet 34 as well as ratchet claw 35. The blade-replacement spring 33 is charged when wire 36 wound round the blade-supporting shaft 19 is drawn out, and in this case, the ratchet claw 35 engages with the ratchet 34 to cause the blade-supporting shaft 19 not to rotate. When replacing blade 18, the ratchet claw 35 is actuated by supporting-shaft moving means 21 and disengages from the ratchet 34, thus, the blade-supporting shaft 19 is rotated by torsional moment of the blade-replacement spring and fresh blade 18 is positioned to face the photoreceptor 2. Since the fresh blade 18 is also supported on the blade-supporting shaft 19 in a manner that the blade can swing around the shaft member 13*b*, it is in parallel with the photoreceptor 2 when it is in contact with the photoreceptor 2.

As stated above, the invention can provide a cleaning device wherein a blade can be affixed easily, a blade can be in contact with an image carrier to be in parallel with and uniform against the image carrier constantly, and no improper cleaning is caused, owing to a supporting member provided for supporting a blade so that the blade may swing around the circumferential surface of an image carrier, to be concrete, to a bearing member provided internally at the central portion of a blade-holder as well as a shaft member passing through the bearing member.

Figure 25:
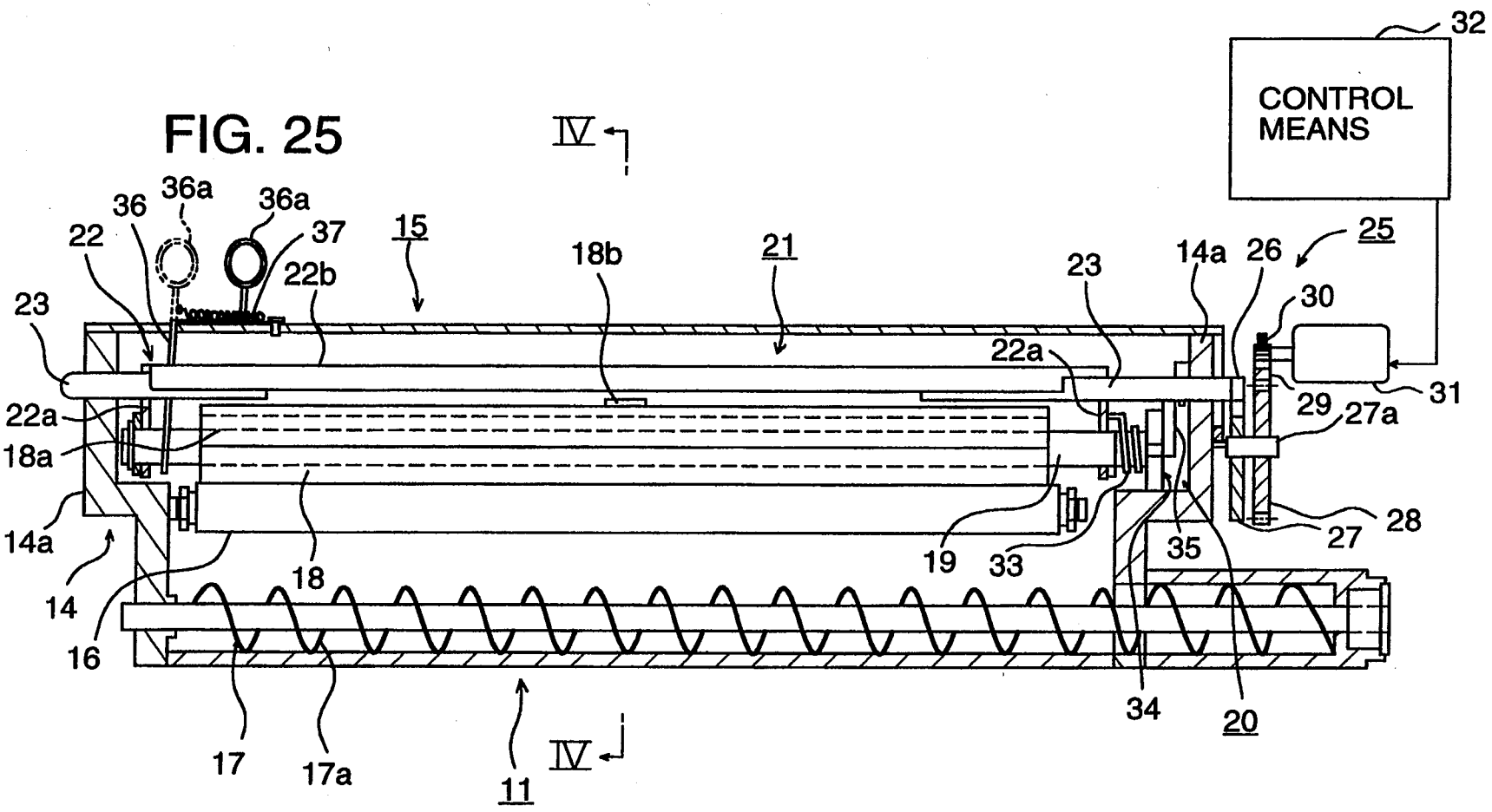
FIG. 25 is a front sectional view of a cleaning unit.
Figure 26:
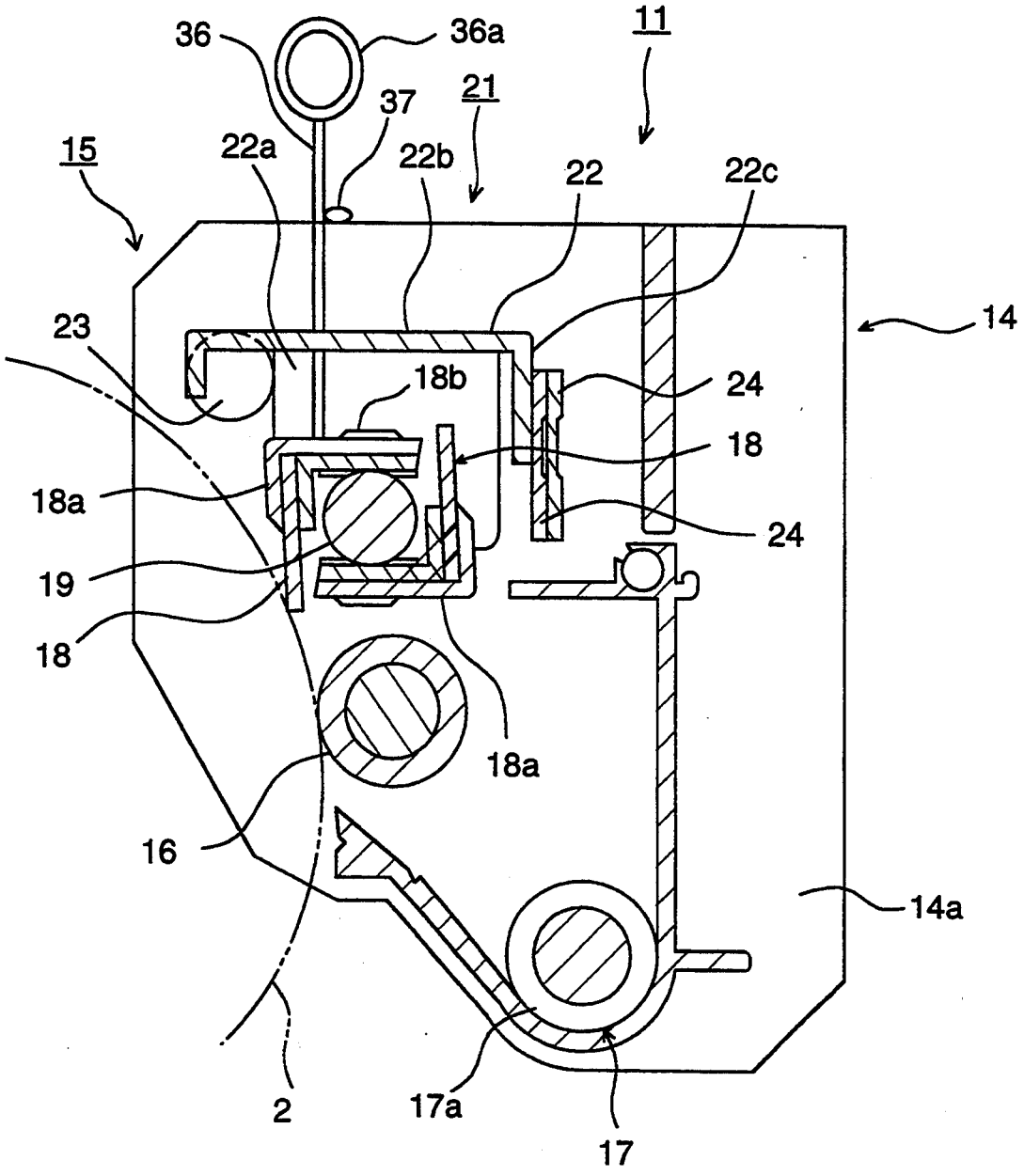
FIG. 26 is a sectional view taken on line IV—IV in FIG. 25.

Next, a more specific example of a cleaning device of the invention will be explained as follows, referring to the drawings attached herewith. FIG. 25 is a front sectional view of a cleaning unit and FIG. 26 is a sectional view taken on line IV—IV in FIG. 25.

First, the structure of cleaning unit 11 will be explained in detail as follows, referring to FIGS. 25 and 26. The cleaning unit 11 is the same as that in FIG. 7 in terms of structure, and accordingly, only different points in terms of structure and operation will be explained as follows.

Next, supporting-shaft rotating means 20 that rotates blade-supporting shaft 19 in the predetermined direction for blade replacement will be explained as follows. Blade-replacement spring 33 is wound round one end of the blade-supporting shaft 19 protruding from holder-side-plate 22*a* of shaft-holder 22 toward the internal surface of side plate 14*a* of housing 14. On the tip of the blade-replacement spring, there is affixed ratchet 34 that controls a rotation of the blade-supporting shaft 19 and brings blade 18 into pressure contact with photoreceptor 2 at a predetermined angle. On the ratchet 34, there are formed cutouts in quantity identical to that of blades 18 (two cutouts located at two positions symmetrical about the shaft in the present example) at predetermined intervals, and these cutouts engage with ratchet claw 35 provided on the side plate 22*a* of the shaft-holder 22.

The blade-replacement spring 33 is required to have elasticity capable of swinging the blade-supporting shaft 19 on which two blades 18 are affixed over a predetermined angle or more, 180 degrees or more in the present example, and this elasticity is charged by an elastic energy charging means that is linked with the blade-supporting shaft 19. In the present example, a drawing member such as wire 36 or the like is wound round one end of the blade-supporting shaft 19, and the wire 36 is drawn out for charging. The wire 36 is wound in the direction opposite to that of rotation of the blade-supporting shaft 19, and when setting cleaning means 15 initially, the wire 36 is drawn out by a finger held in ring 36*a* attached on the tip for charging the blade-replacement spring with elastic energy. In this case, the wire 36 drawn out is hooked on spring member 37, and ratchet claw 35 engages with one cutout of ratchet 34 to cause the blade-supporting shaft 19 not to rotate. During the course of replacing blade 18, ratchet claw 35 disengages and thereby the blade-supporting shaft 19 is rotated by torsional moment of the blade-replacement spring 33 until the ratchet claw 35 engages with the succeeding cutout of the ratchet 34. The wire 36 drawn out is wound round the blade-supporting shaft 19 again when it rotates, and the speed of the wire for being wound is decelerated by elasticity of spring member 37. Namely, the speed of rotation of the blade-supporting shaft 19 is governed by the spring member 37 and scattering of toner sticking to blade 18 can be prevented. After all blades 18 set initially have been used up, supporting pin 18*b* of blade-holder 18*a* is removed on the occasion of maintenance for replacing with fresh blades 18, and the wire 36 is drawn again for charging.

Figure 27:
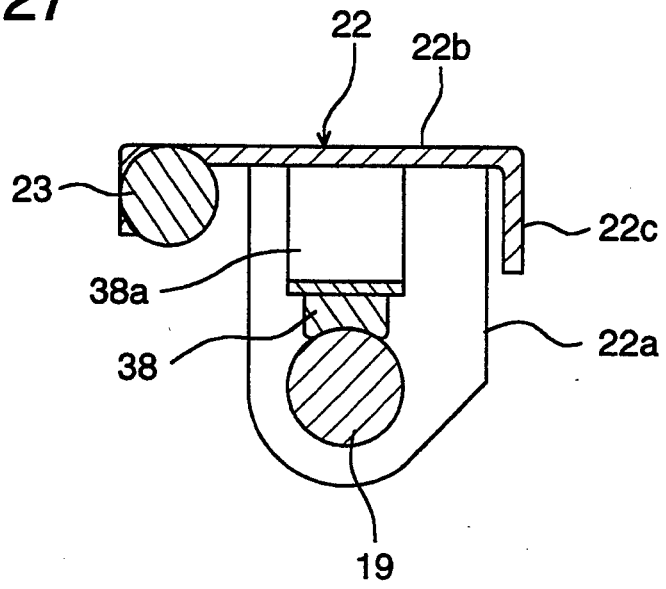
FIG. 27 is a sectional view of an end of a cleaning unit in another example.

Though elasticity of the spring member 37 on which the wire 36 is hooked is used as a braking means in the example mentioned above, the invention is not limited thereto provided that the braking means can govern the rotation of the blade-supporting shaft 19. Another example will be explained as follows, referring to FIGS. 27–29. In FIG. 27, friction member 38 that comes in contact with the blade-supporting shaft 19 is used as a braking means. The friction member 38 such as, for example, felt, sponging foam, rubber or cork makes pressure contact, owing to its own elasticity, with the blade-supporting shaft 19, and applies thereon frictional resistance force to decelerate the speed of rotation. Incidentally, the friction member 38 is affixed on metal fitting 38*a* that is in contact with shaft-holder 22.

Figure 28:
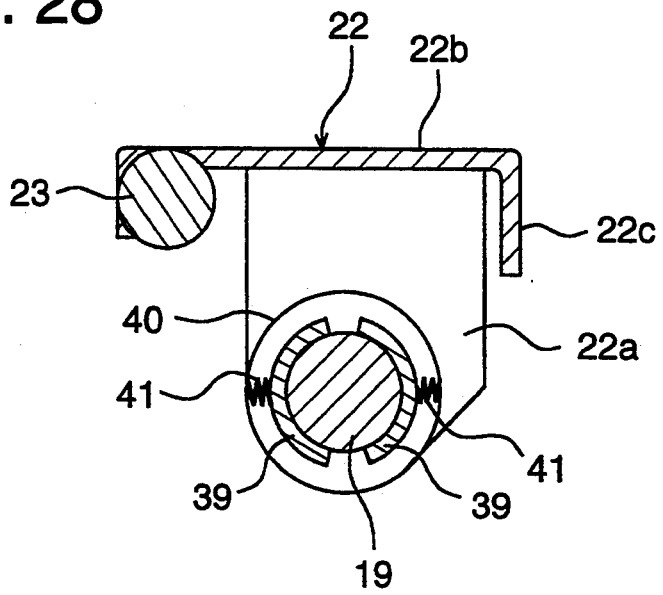
FIG. 28 is a sectional view of an end of a cleaning unit in still another example.

In FIG. 28, friction members 39 are arranged in a form that the blade-supporting shaft 19 is surrounded by the friction members, and pressure spring 41 that is supported by holder 40 is mounted on the back of each friction member 39. In the present example, elasticity of the pressure spring 41 brings the friction member 39 into contact with the blade-supporting shaft 19, thus, frictional resistance is obtained.

Figure 29:
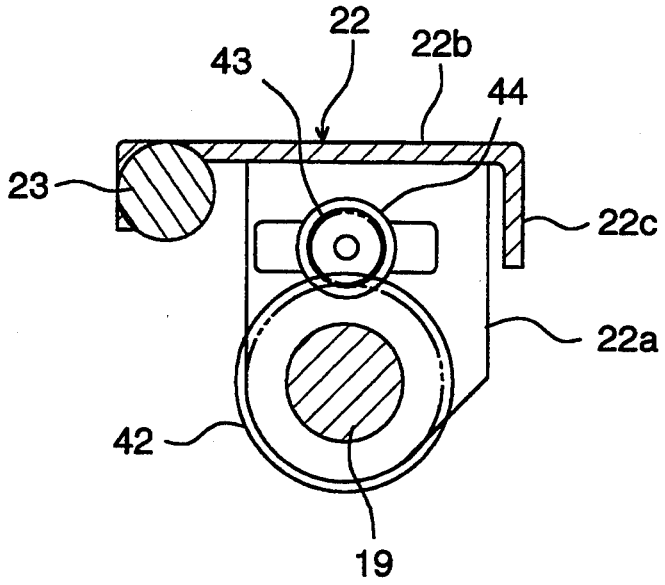
FIG. 29 is a sectional view of an end of a cleaning unit in further example.

In FIG. 29, gear 42 is affixed on the end of the blade-supporting shaft 19, and the gear 42 is engaged with oil damper gear 43 which is linked with oil damper 44 provided on holder side plate 22*a* of shaft-holder 22. Thus, the rotation of the blade-supporting shaft 19 is decelerated in terms of speed by damping force of the oil damper. Incidentally, the oil damper may also be connected directly with the blade-supporting shaft 19 without requiring existence of the gear.

As stated above, in the seventeenth embodiment of the invention, even in the case of arrangement wherein elasticity of an elastic member is used as a driving source for a rotation of a blade-supporting shaft, it is possible to prevent abrupt rotation in the course of blade replacement and to prevent toner scattering to the outside, by providing a brake means in a supporting-shaft rotating means.

In the eighteenth through the twentieth embodiments, it is possible to apply a load on a blade-supporting shaft and thereby to decelerate the speed of rotation thereof by providing, as a brake means, a friction member that comes in contact with the blade-supporting shaft and thereby applies frictional resistance thereon, a pressure spring that presses the back of a friction member, or an oil damper connected to the blade-supporting shaft, respectively.

In the twenty-first embodiment of the invention, it is possible to charge an elastic member with elastic energy by drawing out a drawing member wound round a blade-supporting shaft. Moreover, the rewinding speed in the course of blade replacement can be decelerated by elastic resistance force of a spring member connected to the drawing member, and the rotation of the blade-supporting shaft can be decelerated.

Figure 30:
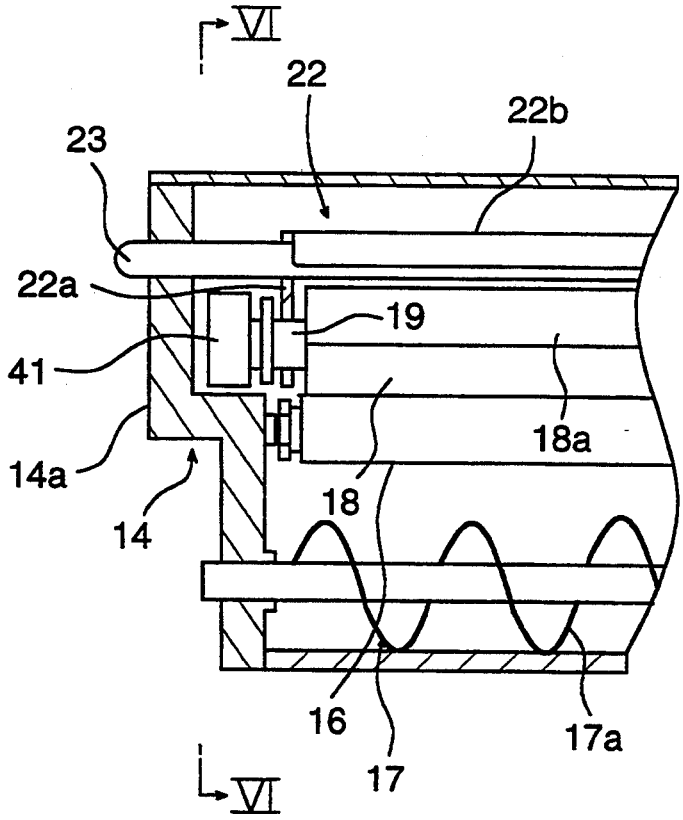
FIG. 30 is a partial front section of a cleaning unit of other example.

Still another example of a cleaning device of the invention will be explained as follows, referring to the drawings attached herewith. FIG. 30 is a partial front section of a cleaning unit and FIG. 31 is a sectional view taken on line VI—VI in FIG. 30.

Figure 31:
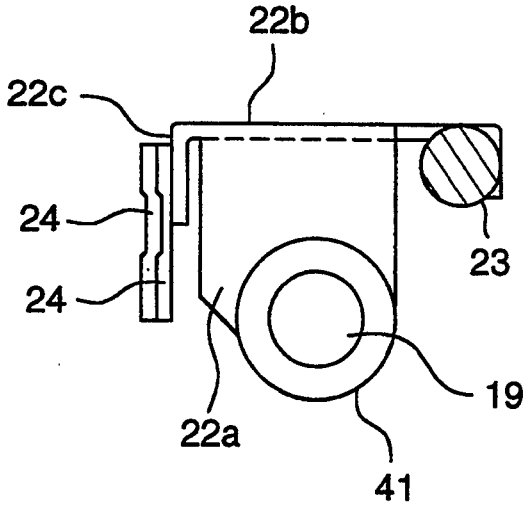
FIG. 31 is a sectional view taken on line VI—VI in FIG. 30.
Figure 32:
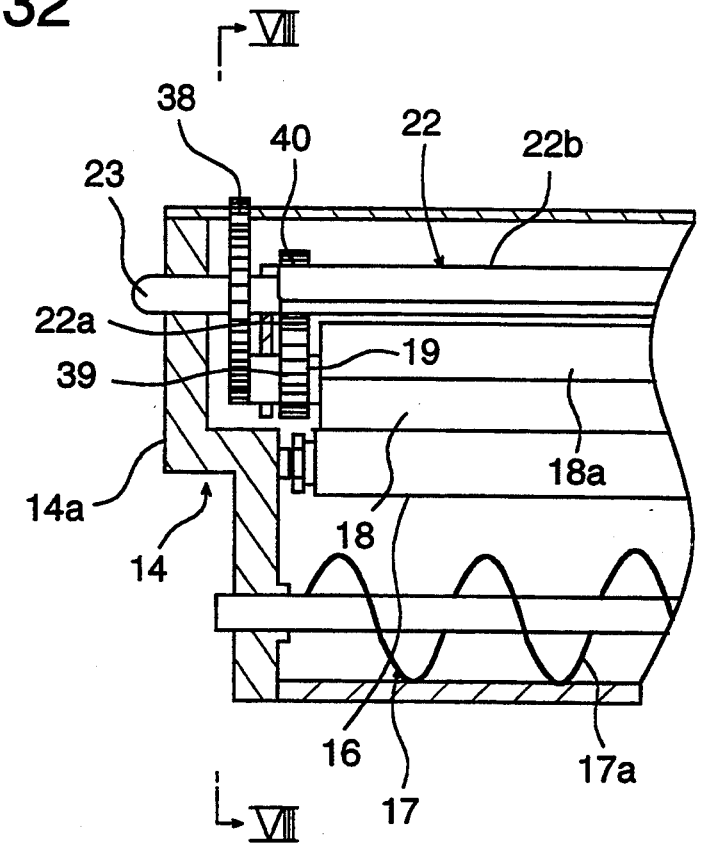
FIG. 32 is a partial front section of a cleaning unit of another example.
Figure 33:
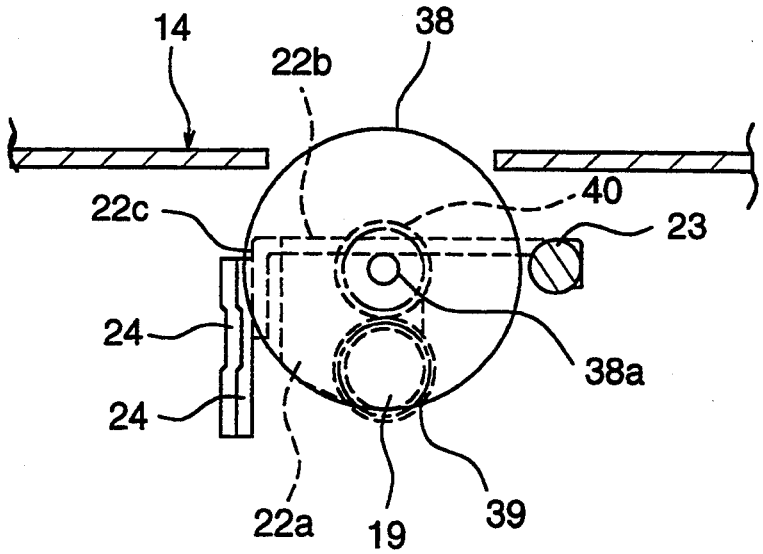
FIG. 33 is a sectional view taken on line VIII—VIII in FIG. 32.

As an another example, a swinging knob may be used as an elastic energy charging means as shown in FIGS. 30 and 31. The swinging knob 41 is to be affixed on the end of blade-supporting shaft 19, and its function is the same as that of wire 36. Further, it is possible to employ an arrangement wherein swinging force of swinging knob 38 is transmitted to blade-supporting shaft 19 through a swinging force transmitting means as shown in FIGS. 32 and 33. The swinging force transmitting means may naturally be either the one employing gear 39 affixed on blade-supporting shaft 19 and gear 40 that engages with the gear 39 and shares shaft 38*a* with swinging knob 38, or the one employing pulleys, timing belts and V-belts instead of the gears mentioned above.

As described above, in the twenty-second embodiment of the invention, an elastic energy charging means provided on a supporting-shaft rotating means makes it possible to replace a blade repeatedly and surely in a simple arrangement and to contribute to miniaturization of an apparatus.

In the twenty-third embodiment of the invention, a drawing member which is wound round a blade-supporting shaft and serves as a charging means makes it possible for the charging means to require less space and it makes it possible to charge from the outside of a cleaning device.

In the twenty-fourth embodiment of the invention, a swinging knob used for charging makes it possible to charge surely, without causing any fear that a drawing member is broken when drawing.

In the twenty-fifth embodiment of the invention, a swinging force transmitting means provided therein makes it possible to charge from the outside of a cleaning device and to contribute to miniaturization of an apparatus.

What is claimed is:

1. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) a memory for rewritably storing a preset blade replacement timing for replacing a used blade with a new blade; and (g) means for controlling said supporting shaft rotating means according to the preset blade replacement timing stored in said memory, wherein a used blade is replaced with a new blade by rotating said blade supporting shaft.

2. The cleaning device of claim 1, wherein said second position includes a releasing position at which a cleaning operation by a blade is released and a replacement position at which a used blade is replaced.

3. The cleaning device of claim 2, wherein said means for controlling said supporting shaft rotating means rotates said blade supporting shaft when said blade supporting shaft is moved to said replacement position.

4. The cleaning device of claim 2, wherein said supporting shaft moving means includes a cam mechanism coupled to said blade supporting shaft for enabling said blade supporting shaft to sequentially move to said first position, said releasing position and said replacement position.

5. The cleaning device of claim 4, wherein said cam mechanism includes a movement regulating member for inhibiting a blade to directly move from said first position to said replacement position.

6. The cleaning device of claim 2, wherein said supporting shaft moving means includes a sensor for detecting said blade supporting shaft positioned at said releasing position and said replacement position.

7. The cleaning device of claim 2, wherein said movement control means includes means for enabling said blade supporting shaft to return to said releasing position after a predetermined period of time has elapsed since a used blade was replaced at said replacement position.

8. The cleaning device of claim 1, wherein said blade supporting shaft rotating means includes a resilient member for urging said blade supporting shaft to rotate.

9. The cleaning device of claim 8, wherein said blade supporting shaft rotating means further comprises:

a positioning member for stopping a rotation of said blade supporting shaft urged by said resilient member at angular positions corresponding to respective positions of said plurality of cleaning blades on said blade supporting shaft; and a lock member for locking said blade supporting shaft in place after said blade supporting shaft is stopped by said positioning member.

10. The cleaning device of claim 1, further comprising a housing for accommodating said blade supporting shaft therein, wherein said supporting shaft moving means includes:

oscillating means for oscillating said blade supporting shaft along a circular path from said first position to said replacement position through said releasing position, and wherein said blade supporting shaft rotating means includes a resilient member for urging said oscillating means to rotate in the rotation direction reverse to a returning rotation direction to said releasing position from said replacement position.

11. The cleaning device of claim 10, wherein said housing includes a seal member which is in a friction contact with a holder for holding each of said plurality of cleaning blades, at said releasing position.

12. The cleaning device of claim 1, wherein said blade supporting shaft includes a supporting member for pivotally supporting said new blade with respect to the surface of said image carrier.

13. The cleaning device of claim 12, further comprising:

a set of blade holders between which said new blade is interposed;

a bearing member provided in a substantially center portion of said set of blade holders; and a shaft member for supporting said blade holders through said bearing member; and one end of said shaft member being fixed on said blade supporting shaft.

14. The cleaning device of claim 1, further comprising a resilient member for applying a torque to said blade supporting shaft, wherein said blade supporting shaft rotating means includes a brake for braking a rotation of said blade supporting shaft.

15. The cleaning device of claim 14, wherein said brake comprises a friction member which is in pressure contact with said blade supporting shaft.

16. The cleaning device of claim 15, wherein said friction member comprises a pressure spring, the pressure contact surface of which is pressed to said blade supporting shaft.

17. The cleaning device of claim 14, wherein said brake comprises an oil damper which is coupled to said blade supporting shaft.

18. The cleaning device of claim 1, further comprising:

a resilient member for applying a torque to said blade supporting shaft, wherein said blade supporting shaft rotating means includes a pulling member wound around said blade supporting shaft which functions to charge an elastic energy to said resilient member; and a spring member coupled to said pulling member which functions to decelerate a rotation of said blade supporting shaft.

19. The cleaning device of claim 1, further comprising:

a resilient member for applying a torque to said blade supporting shaft, wherein said blade supporting shaft rotating means includes means for charging an elastic energy to said resilient member.

20. The cleaning device of claim 19, wherein said elastic energy charging means comprises a pulling member wound around said blade supporting shaft.

21. The cleaning device of claim 19, wherein said elastic energy charging means comprises a rotating member that rotates around said blade supporting shaft.

22. The cleaning device of claim 21, wherein said rotating member includes transmitting means coupled to said blade supporting shaft, for transmitting said torque.

23. An image forming apparatus comprising:

(a) an image carrier on which a latent image is formed;

(b) driving means for rotating said image carrier;

(c) a developing unit for developing the latent image on said image carrier;

(d) a plurality of cleaning blades that are respectively capable of coming into contact with said image carrier for cleaning a remaining amount of toner from a surface of said image carrier after an image transfer operation;

(e) a blade supporting shaft for supporting said plurality of cleaning blades;

(f) supporting shaft moving means for moving said blade supporting shaft between a first position at which one of said plurality of cleaning blades is in contact with said image carrier and a second position at which said one blade is separated from said image carrier;

(g) means for rotating said blade supporting shaft;

(h) a memory for rewritably storing a preset blade replacement timing for replacing a used blade with a new blade;

(i) means for controlling said rotating means according to the preset blade replacement timing stored in said memory, wherein a used blade is replaced with a new blade by rotating said blade supporting shaft at said second position;

(j) movement control means for controlling each movement of said supporting shaft moving means, said driving means and said developing unit; and (k) a circuit provided in said movement control means, for controlling each operation during a blade replacement such that:

said developing unit is operated to adhere toner to the entire surface of said image carrier while said image carrier is being rotated;

said supporting shaft moving means is operated to move a new blade to said first position; and said new blade is moved to said second position after slidably contacting the toner adhered on said image carrier surface.

24. An image forming apparatus comprising:

(a) an image carrier for holding a toner image thereon to transfer the toner image onto a recording sheet;

(b) a plurality of cleaning blades capable of coming into contact with said image carrier for cleaning a surface of said image carrier;

(c) a blade supporting shaft for supporting said plurality of cleaning blades thereon;

(d) supporting shaft moving means for moving said blade supporting shaft between a first position in which one of said plurality of cleaning blades is in contact with said image carrier and a second position in which said one blade is separated from said image carrier;

(e) means for controlling said supporting shaft moving means;

(f) rotating means for rotating said blade supporting shaft;

(g) means for controlling said rotating means, wherein a used blade is replaced with a new blade by rotating said blade supporting shaft;

(h) replacement timing input means for inputting a blade replacement timing;

(i) a memory for rewritably storing a new blade replacement timing input from said replacement timing input means each time a used blade is replaced with a new blade; and (j) control means for controlling a replacement of a used blade according to the replacement timing stored in said memory.

25. The image forming apparatus of claim 24, further comprising a detector for detecting a recording sheet ejected from said apparatus, wherein the replacement of the used blade is conductible after the detection of said ejected recording sheet by said detector.

26. The image forming apparatus of claim 24, further comprising a detector for detecting a turning ON of a power supply to said apparatus, wherein the replacement of the used blade is conductible after a detection by said detector of a turning ON of said power supply.

27. The image forming apparatus of claim 24, further comprising:

a fixing device for fixing by means of heat and pressure a toner image transferred to said recording sheet; and means for judging if a fixing temperature of said fixing device reaches a temperature at which a replacement of a used blade is conductible when a power supply to said apparatus is turned ON.

28. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) means for controlling said supporting shaft rotating means, so that a used blade is replaced with a new blade by rotating said blade supporting shaft; and wherein said second position includes a releasing position at which a cleaning operation by a blade is released and a replacement position at which a used blade is replaced; and said supporting shaft moving means includes a sensor for detecting said blade supporting shaft positioned at said releasing position and said replacement position.

29. The cleaning device of claim 28, wherein said movement control means includes means for enabling said blade supporting shaft to return to said releasing position after a predetermined period of time has elapsed since a used blade was replaced at said replacement position.

30. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) means for controlling said supporting shaft rotating means, so that a used blade is replaced with a new blade by rotating said blade supporting shaft; and further comprising:

a housing for accommodating said blade supporting shaft therein; and wherein:

said supporting shaft moving means includes:

oscillating means for oscillating said blade supporting shaft along a circular path from said first position to said replacement position through said releasing position; and a resilient member for urging said oscillating means to rotate in a rotation direction that is reverse to a returning rotation direction to said releasing position from said replacement position.

31. The cleaning device of claim 30, wherein said housing includes a seal member which is in a friction contact with a holder for holding each of said plurality of cleaning blades, at said releasing position.

32. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) means for controlling said supporting shaft rotating means, so that a used blade is replaced with a new blade by rotating said blade supporting shaft; and wherein:

said blade supporting shaft includes a supporting member for pivotally supporting said new blade with respect to the surface of said image carrier, and, further comprising:

a set of blade holders between which said new blade is interposed:

a bearing member provided in a substantially center portion of said set of blade holders;

a shaft member for supporting said blade holders through said bearing member; and one end of said shaft member being fixed on said blade supporting shaft.

33. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) means for controlling said supporting shaft rotating means, so that a used blade is replaced with a new blade by rotating said blade supporting shaft; and further comprising:

a resilient member for applying a torque to said blade supporting shaft, wherein said blade supporting shaft rotating means includes means for charging an elastic energy to said resilient member; and said means for charging said elastic energy comprises a pulling member wound around said blade supporting shaft.

34. The cleaning device of claim 33, wherein said means for charging said elastic energy comprises a rotating member that rotates around said blade supporting shaft.

35. The cleaning device of claim 34, wherein said rotating member includes transmitting means coupled to said blade supporting shaft, for transmitting said torque.

36. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) a memory for rewritably storing a preset blade replacement timing for replacing a used blade with a new blade; and (g) means for controlling said supporting shaft rotating means according to the preset blade replacement timing stored in said memory, wherein a used blade is replaced with a new blade by rotating said blade supporting shaft; and (h) a resilient member for applying a torque to said blade supporting shaft, wherein said blade supporting shaft rotating means includes a brake for braking a rotation of said blade supporting shaft.

37. A cleaning device comprising:

(a) a plurality of cleaning blades that are respectively capable of coming into contact with an image carrier for cleaning a surface of said image carrier;

(b) a blade supporting shaft for supporting said plurality of cleaning blades;

(c) supporting shaft moving means for moving said blade supporting shaft between a first position in which one of said plurality of cleaning blades is in contact with said image carrier and a second position in which said one blade is separated from said image carrier;

(d) movement control means for controlling a movement of said supporting shaft moving means;

(e) supporting shaft rotating means for rotating said blade supporting shaft;

(f) a memory for rewritably storing a preset blade replacement timing for replacing a used blade with a new blade; and (g) means for controlling said supporting shaft rotating means according to the preset blade replacement timing stored in said memory, wherein a used blade is replaced with a new blade by rotating said blade supporting shaft;

(h) a resilient member for applying a torque to said blade supporting shaft, wherein said blade supporting shaft rotating means includes a pulling member wound around said blade supporting shaft which functions to charge an elastic energy to said resilient member; and (i) a spring member coupled to said pulling member which functions to decelerate a rotation of said blade supporting shaft.

* * * * *